US011203483B2

(12) United States Patent
Nasu

(10) Patent No.: US 11,203,483 B2
(45) Date of Patent: Dec. 21, 2021

(54) DISCHARGE CONTAINER, CUSTOMIZED DISCHARGE SYSTEM HAVING DISCHARGE CONTAINER, AND DISCHARGE CONTROL METHOD IN DISCHARGE CONTAINER

(71) Applicant: SHISEIDO COMPANY, LTD., Tokyo (JP)

(72) Inventor: Mieko Nasu, Tokyo (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 33 days.

(21) Appl. No.: 16/633,705

(22) PCT Filed: Aug. 1, 2018

(86) PCT No.: PCT/JP2018/028893
§ 371 (c)(1),
(2) Date: Jan. 24, 2020

(87) PCT Pub. No.: WO2019/031358
PCT Pub. Date: Feb. 14, 2019

(65) Prior Publication Data

US 2020/0207538 A1 Jul. 2, 2020

(30) Foreign Application Priority Data

Aug. 9, 2017 (JP) ..... JP2017-154523

(51) Int. Cl.
*B65D 83/64* (2006.01)
*A45D 34/00* (2006.01)
(Continued)

(52) U.S. Cl.
CPC ..... *B65D 83/64* (2013.01); *A45D 34/00* (2013.01); *B65D 83/20* (2013.01); *B65D 83/682* (2013.01); *A45D 2200/055* (2013.01)

(58) Field of Classification Search
CPC ..... B65D 83/20; B65D 83/682; B65D 83/64; A45D 2200/058; A45D 2200/055;
(Continued)

(56) References Cited

U.S. PATENT DOCUMENTS 4,068,829 A * 1/1978 Laurent ..... B29B 7/805 366/159.1
4,397,407 A * 8/1983 Skoupi ..... B29B 7/7647 222/132
(Continued)

FOREIGN PATENT DOCUMENTS

JP 2000-313487 11/2000
JP 2007-297059 11/2007
(Continued)

OTHER PUBLICATIONS

Extended European Search Report for 18845014.2 dated Apr. 12, 2021.
(Continued)

*Primary Examiner* — Charles P. Cheyney
(74) *Attorney, Agent, or Firm* — IPUSA, PLLC

(57) ABSTRACT

A discharge container 1 includes a container body having a discharge face 13, on which a discharge hole 15 is formed, a cylinder part including a discharge space 2 in communication with the discharge hole 15 inside the container body, a piston 3 movable between a first position and a second position, the second position being farther than the first position from the discharge face in the discharge space 2, and a plurality of storage portions 5*a* to 5*e* for storing contents, wherein a plurality of inlet holes respectively corresponding to the plurality of storage portions 5*a* to 5*e* are formed in an inner wall of the discharge space 2, wherein, when the piston 3 is at the second position, the plurality of inlet holes 22*a* to 22*e* communicate with the discharge space 2 between a top face of the piston 3 and the
(Continued)

discharge face, and the contents are ready to flow into the discharge space 2 from the plurality of inlet holes 22*a* to 22*e*, and wherein, when the piston 3 is at the first position, the plurality of inlet holes 22*a* to 22*e* are closed by the piston 3.

14 Claims, 14 Drawing Sheets

(51) Int. Cl.
*B65D 83/20* (2006.01)
*B65D 83/68* (2006.01)

(58) Field of Classification Search
CPC .. A45D 34/00; A45D 34/04; B05C 17/00553; B05C 17/0103; B05C 17/00556
USPC ..... 222/135, 134, 132, 145.5, 145.6, 129.4, 222/63
See application file for complete search history.

(56) References Cited

U.S. PATENT DOCUMENTS 4,473,531 A * 9/1984 Macosko ..... B29B 7/7694 422/133
5,093,084 A * 3/1992 Boden ..... B29B 7/7684 422/133
5,270,013 A * 12/1993 Decker ..... B01J 19/26 222/132
5,445,781 A * 8/1995 Addeo ..... B29B 7/7663 264/328.6
5,512,232 A * 4/1996 Addeo ..... B29C 33/0038 264/240
6,047,861 A * 4/2000 Vidal ..... A61B 17/00491 222/137
6,402,364 B1 * 6/2002 Esclar ..... A45D 19/02 222/135
6,926,695 B2 * 8/2005 Levinson ..... A61B 17/00491 222/145.2
7,445,372 B1 * 11/2008 Engel ..... B01F 7/00758 222/145.6
9,239,428 B2 * 1/2016 Christopher ..... B05C 17/00553
9,289,272 B2 3/2016 Selvitelli
10,076,175 B2 * 9/2018 Wee ..... A45D 40/24
2010/0185322 A1 7/2010 Bylsma et al.
2014/0158717 A1 6/2014 Ettlin

FOREIGN PATENT DOCUMENTS

JP 2008-237693 10/2008
JP 2012-217850 11/2012
JP 2014-168781 9/2014
KR 10-2014-0122386 10/2014
WO 2016/087470 6/2016
WO 2018/077598 5/2018

OTHER PUBLICATIONS

International Search Report for PCT/JP2018/028893 dated Nov. 6, 2018.

* cited by examiner

DISCHARGE CONTAINER, CUSTOMIZED DISCHARGE SYSTEM HAVING DISCHARGE CONTAINER, AND DISCHARGE CONTROL METHOD IN DISCHARGE CONTAINER

TECHNICAL FIELD

The present invention relates to a discharge container including a plurality of storage portions, a customized discharge system including the discharge container, and a discharge control method for controlling discharge in the discharge container.

BACKGROUND ART

As a technique of a container having a plurality of storage sections and discharging a plurality of contents at the same time, a dispensing pack (registered trademark), which is a small package for food that discharges a plurality of types of seasonings, is widely known.

Also known is a hair dye container in which two types of liquid solutions that undergo chemical reactions are stored separately and mixed on a comb (see, for example, Patent Document 1).

In addition, Patent Document 2 proposed a syringe assembly wherein two drugs are stored in two cartridges to push the drugs out of the cartridge and temporarily push them into the assembly so that the two drugs are injected out at the same time from the delivery needle.

PRIOR ART DOCUMENTS

Patent Documents

Japanese Laid-open Patent Application No. 2008-237693
Japanese Laid-open Patent Application No. 2012-217850

SUMMARY OF INVENTION

Problem to be Solved by the Invention

However, the dispense pack is a disposable container that contains only one dispense, and multiple dispenses are not expected to be used.

Similarly, the syringe assembly of Patent Document 2 is required to be disposable, or for post-use cleaning and sterilization prior to a next use, in view of hygienic aspects.

Further, in the hair dye container according to the above-described Patent Document 1, in order to mix two kinds of liquid on the comb, after the discharge operation, the liquid that is mixed in the comb part remains. Therefore, after the discharge operation, it was necessary to clean the inside of the combs by external operation, which was time-consuming. In addition, there was a risk that two types of liquid preparations could volatilize during storage through the comb part, which is a mixing part.

Accordingly, in view of the above-described circumstances, the present invention aims to provide a discharge container having a plurality of receiving portions that does not need to be cleaned inside the container after the discharge operation and prevents the contents from being volatilized other than during the discharge operation.

Means of Solving Problem

In order to solve the above problem, the discharge container according to one aspect of the present invention includes a container body having a discharge face, on which a discharge hole is formed, a cylinder part including a discharge space in communication with the discharge hole inside the container body, a piston movable between a first position and a second position, the second portion being farther than the first position from the discharge face in the discharge space, and a plurality of storage portions for storing contents, wherein a plurality of inlet holes respectively corresponding to the plurality of storage portions are formed in an inner wall of the discharge space, wherein, when the piston is at the second position, the plurality of inlet holes communicate with the discharge space between a top face of the piston and the discharge face, and the contents are ready to flow into the discharge space from the plurality of inlet holes, and wherein, when the piston is at the first position, the plurality of inlet holes are closed by the piston.

Effects of the Invention

According to one aspect, in the discharge container having a plurality of storage portions, cleaning of the inside of the container after the discharge operation is not required, and the volatilization of the contents can be prevented other than during the discharge operation.

MODE OF CARRYING OUT THE INVENTION

Figure 1:
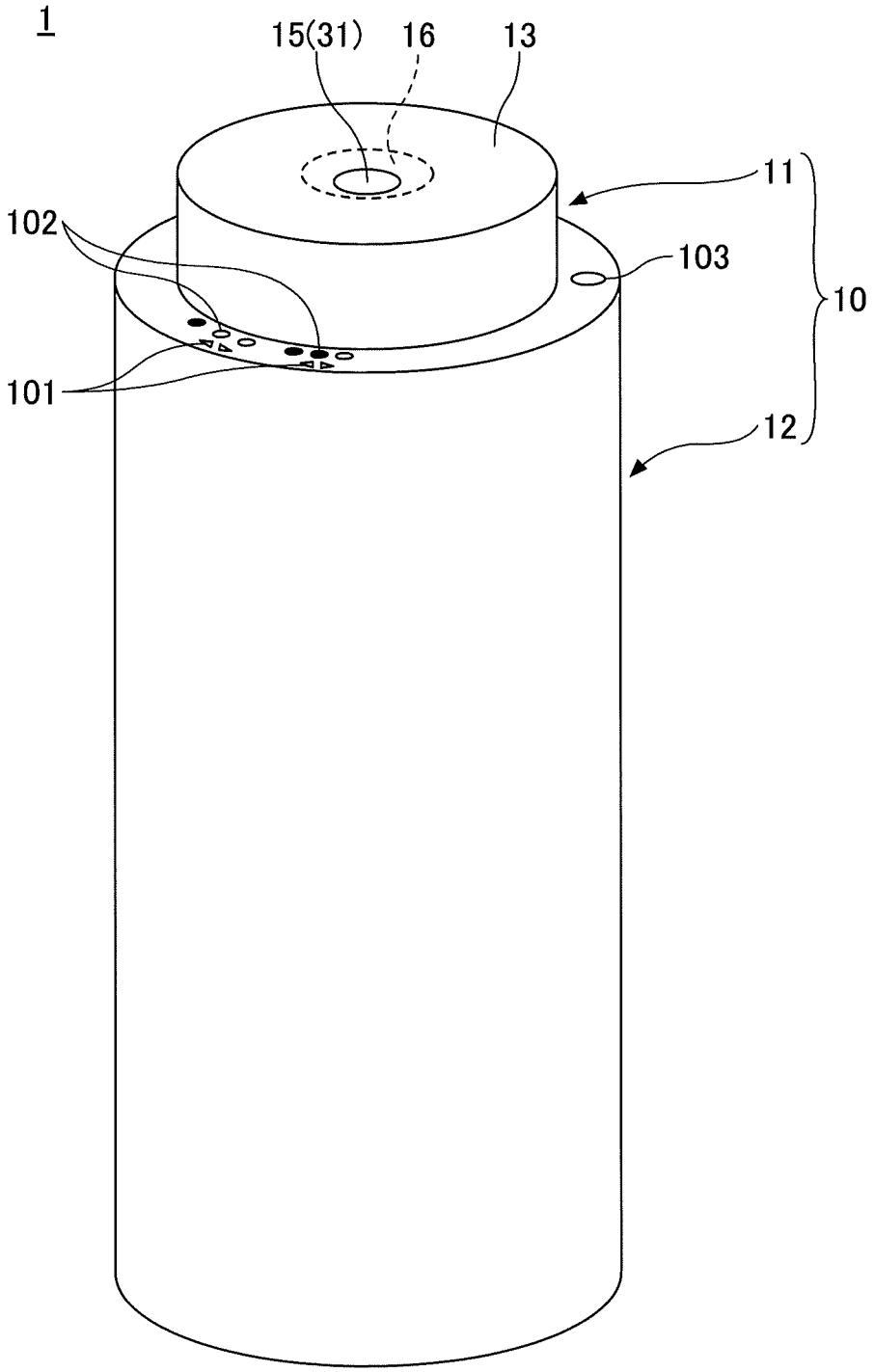
FIG. 1 is an overall view of a discharge container according to a first embodiment of the present invention.

Hereinafter, the embodiments for carrying out the present invention will be described with reference to the figures. In the following drawings, the same components are indicated by the same reference numerals, and redundant explanations may be omitted.

First Embodiment

FIG. 1 is an overall view of a discharge container according to a first embodiment of the present invention. The discharge container of the present invention contains, for example, a cosmetic agent (a basic cosmetic agent, a cosmetic agent for base makeup, and a cosmetic agent for point makeup), a kneaded perfume, a seasoning, and the like as contents.

As illustrated in FIG. 1, the discharge container 1 according to this embodiment is surrounded by a container body (cover, case) 10 having a discharge face 13 on which a discharge hole 15 is formed.

In the example illustrated in FIG. 1, the container body 10 is formed by combining cylinders of different diameters in a stepped shape. Specifically, the container body 10 is formed of a discharging cylinder 11 and a receiving cylinder 12. In this example, the discharging cylinder 11 and the receiving cylinder 12 are illustrated to be in a cylindrical shape, but it may be in a shape of rectangular cylinder.

In this embodiment, an operation unit (operation switch) 101, a light emitting unit 102, and a power switch 103 are provided on the upper surface near the outer periphery of the receiving cylinder 12 as an example of the outer surface of the receiving cylinder 12.

The operation unit 101 adjusts the discharge amount (mixing ratio) of the discharged contents. The light emitting unit 102 emits light so as to indicate a selected amount of discharge selected by the operation unit 1011. In the example illustrated in FIG. 1, a display example in which the discharge amount can be selected in three stages for a plurality of types of contents is illustrated. Although FIG. 1 illustrates two sets of an operation unit 1011 and the light emitting unit 102, three or more kinds of contents may be included in the discharge container 1.

In the configuration in which the discharge amount is selected in the three stages, for example, when none of the light emitting unit 102 is illuminated, the "no discharge" of the contents thereof is indicated; when one light is illuminated, the "discharge amount is small"; when two light are illuminated, the "discharge amount is medium"; and when three light is illuminated, the "discharge amount is large".

The number of operation units 101 may be increased or decreased depending on the number of types of contents inside the discharge container 1. The shape of the operation unit 1011 is illustrated as a triangle in FIG. 1. However, the shape of the operation unit 1011 may be any other shape provided that the discharge amount of the contents can be manipulated.

Figure 7:
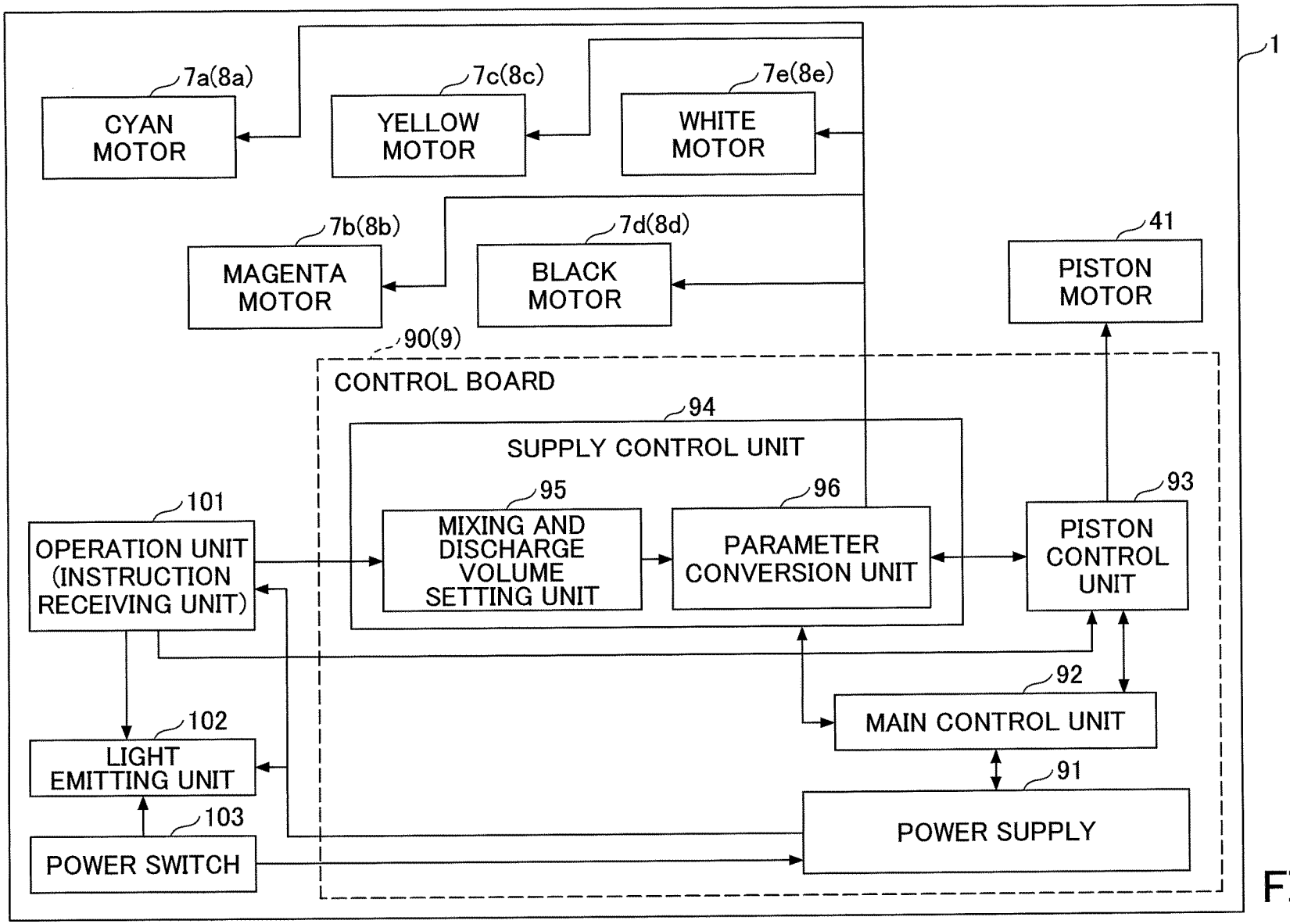
FIG. 7 is a control block diagram for the discharge container according to the first embodiment.

The power switch 103 turns ON/OFF the power supply 91 of the discharge container 1 (see FIG. 7).

In the present example, the upper surface of the container body 10 is the discharge face 13, and a recess 16 that is recessed inwardly is formed in a bowl-shaped (pan-shaped) around the discharge hole 15 on the discharge face 13.

Figure 2A:
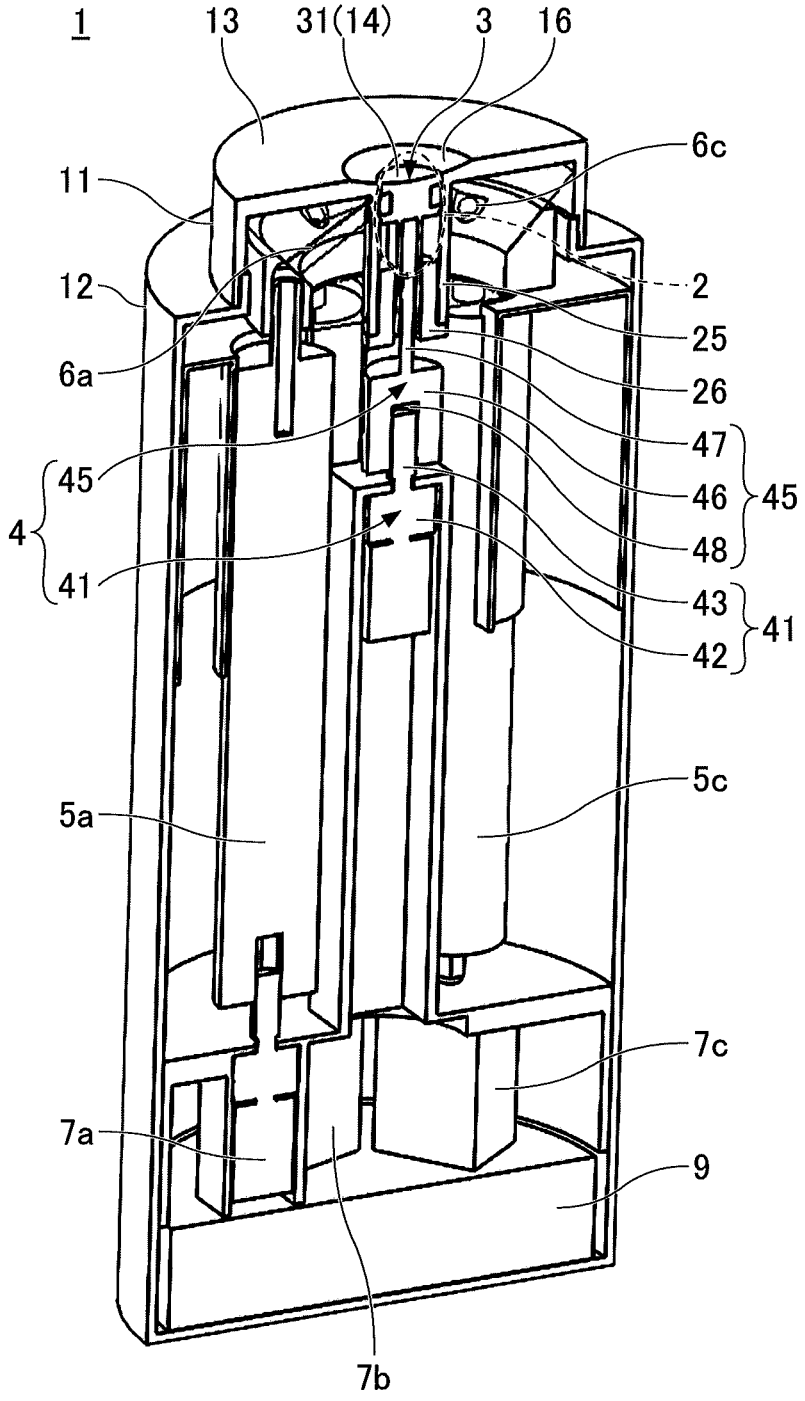
FIG. 2A is an example of a cross-sectional view of the discharge container of FIG. 1, in which a piston is located at a first position to be in a standby state.

A piston 3 is provided in the discharge space 2 inside the discharge hole 15 (see FIG. 2A). In the example of FIG. 1, the circumference of the piston 3 provided in the discharge space 2 in communication with the discharge hole 15 and the discharge hole 15 are of the same size.

The piston 3 is in the first position when the power supply is turned OFF or when the power is turned ON after discharge and in the standby position. In this embodiment, the top face 31 of the piston 3 is substantially identical to the opening face 14 of the discharge hole 15 (see FIG. 2A).

[Internal Cross-Section of Discharge Container]

Figure 2B:
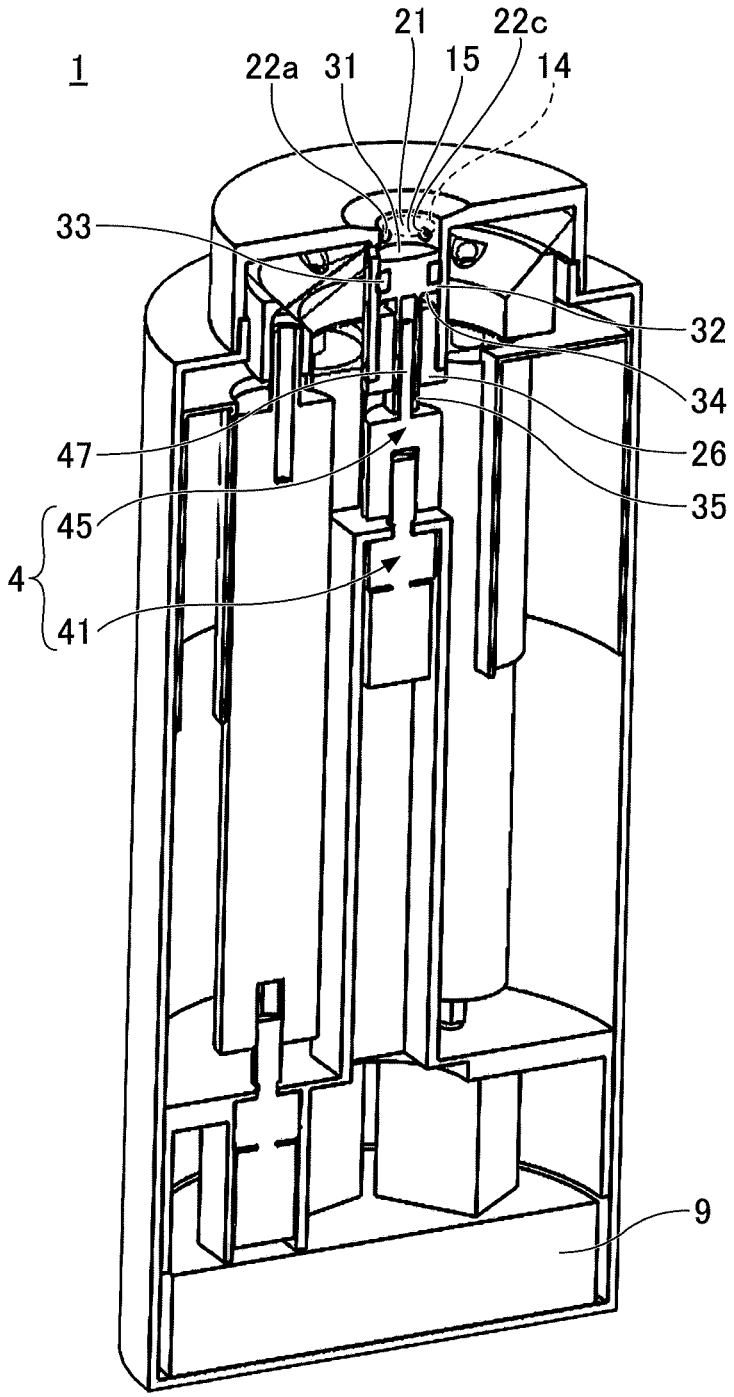
FIG. 2B illustrates a state in which the piston of the discharge container of FIG. 2A is at a second position.

FIGS. 2A and 2B are examples of cross-sectional views of the discharge container of FIG. 1.

As illustrated in FIGS. 2A and 2B, a cylinder part 25 having a discharge space 2 is provided inside the container body 10, and a piston 3 is installed in the discharge space 2. In the internal space of the cylinder part 25, the discharge space 2 that communicates with the discharge hole 15 (opens) inside the container body 10 and is surrounded by the inner wall 21 is formed.

The piston 3 fits inside the inner wall 21 of the discharge space 2 and is movable between a first position illustrated in FIG. 2A and a second position illustrated in FIG. 2B that is apart from the discharge hole 15 by the first position thereof. The head of the piston 3 in FIGS. 2A and 2B is cylindrical or elliptical cylindrical, in which the side surface 32 is adhesive to the inner side (inner wall 21) of the discharge space 2.

The container body 10 further includes a plurality of storage portions 5*a* to 5*e* for each of a plurality of storage portions of different types.

In addition, because FIGS. 2A and 2B are longitudinal cross-sectional views, the two front storage portions 5*a* and 5*c* are visible in the drawings. However, in the present example, the five storage portions 5*a*, 5*b*, 5*c*, 5*d*, and 5*e* are provided in the discharge container 1 because the plurality of storage portions are also provided in the front and rear of the FIGS. 2A and 2B.

Inlet holes 22*a* to 22*e* are formed in the inner wall 21 of the discharge space 2, respectively, corresponding to the storage portions 5*a* to 5*e*.

When the piston 3 is in the second position illustrated in FIG. 2B, the inlet holes 22*a* to 22*e* communicate with (are opened) the discharge space 2 between the top face 31 of the piston 3 and the discharge face 13, and the contents are respectively able to enter the discharge space 2 from the inlet holes 22*a* to 22*e*.

When the piston 3 is in the first position illustrated in FIG. 2A, a plurality of inlet holes 22*a* to 22*e* are closed by the piston 3 in the discharge space 2.

In the outer peripheral surface (side surface) 32 of the piston 3, a sealing portion 33 is provided in the portion in contact with the inlet holes 22*a* to 22*e* when the piston 3 is in the first position to improve sealing for sealing the inlet holes.

For example, in the example illustrated in FIGS. 2A and 2B, the seal portion 33 of the piston 3 is made of HDPE (high density polyethylene) or PP (polypropylene) and the seal portion 33 of the piston 3 is made of a soft material such as NBR (nitrole rubber), silicone rubber, thermoplastic elastomer (olefinic, styrene).

Inside the discharge container 1, each of the storage portions 5*a* to 5*e* of the plurality of storage portions and each of the inlet holes 22*a* to 22*e* are connected, respectively, with a plurality of supply passages 6*a* to 6*e* through which each of the plurality of contents passes.

Further, the discharge container 1 illustrated in FIGS. 2A and 2B is provided with the extrusion parts 7*a* to 7*e* at the lower side of the storage portions 5*a* to 5*e*.

Here, the driving of the piston 3 will be described. The piston 3 is driven to move by a piston driving unit 4 provided at the lower portion of the piston 3.

In this example, because the discharge face 13 on which the discharge hole 15 is formed is the upper surface of the container body 10, the piston 3 can be moved up and down between the first position illustrated in FIG. 2A and the second position illustrated in FIG. 2B.

The piston 3 moves up and down the inside of the cylinder part (cylinder portion) 25 constituting the discharge space 2. In the present configuration example, a stopper 26 is provided between the piston 3 and the piston drive unit 4 to regulate the position of the piston 3 when the piston 3 is in the lowest second position. The stopper 26 is generally cylindrical and is positioned so that the outer peripheral surface fits into a portion of the inner wall 21 of the cylinder part 25, and the upper surface of the stopper 26 functions as the bottom of the discharge space 2.

In the example of FIGS. 2A and 2B, the piston drive unit 4 includes a piston motor 41 which is a rotating motor (positioning gear motor) generating rotating force and a rotation conveyer 45 which is a connecting screw (rotation screw) interposed between the piston motor 41 and the piston 3.

Specifically, in the present configuration example, a piston rod 35 having the shape of an female threaded piston having a lower opening and a spiral groove on an inner peripheral surface is formed below the discharge hole 15 of the piston 3. A piston rod 35 is formed through the hollow portion of the stopper 26.

The rotation conveyer 45 has a male threaded bearing shape, and a male screw 47, which is an upper protruding screw portion, is formed on the upper side of the rotation conveyer 45 that fits with the piston 3. A bearing hole 48 is formed in the threaded head portion 46 below the rotation conveyer 45 to engage the rotation shaft 43 which is driven to rotate by the motor portion 42 in the piston motor 41.

As described above, when the rotation conveyer 45 and the piston 3 are fitted together like thread, in the piston driving unit 4, the rotation conveyer 45 transmits the rotation force of the piston motor 41 as the movement force of the piston 3.

On the outer peripheral surface of the piston rod 35, a plurality of protrusions or grooves extending vertically are provided in an asymmetric manner, and the protrusions or grooves engage the grooves or protrusions extending vertically provided on the inner surface of the stopper 26.

In this configuration, when the rotation conveyer 45 rotates, the rotation force by the piston motor 41 is transmitted as the moving force in the traveling direction of the piston 3 by limiting the rotation of the piston 3. In the examples of FIGS. 2A and 2B, the piston drive unit 4 is configured by a piston motor (rotary motor) 41 and a rotation conveyer 45 configured by a rotation screw. However, a wound spring may be used in place of the rotation screw, or another drive motor may be used in place of the rotation motor.

Next, the driving of the supply from the storage portions 5*a* to 5*e* to the inlet holes 22*a* to 22*e* according to the present embodiment will be described.

According to this embodiment, the plurality of extrusion parts 7*a* to 7*e* adjusts the supply amount (the inflow amount) of each contents from each storage portion to the discharge space 2, pushes out each content from each storage portion 5*a* to 5*e*, and transfers them to each inlet hole 22*a* to 22*e* via each supply passage 6*a* to 6*e*. The plurality of extrusion parts 7*a* to 7*e* are constructed, for example, of a gear motor and function as a plurality of extrusion-type transfer units. The extrusion parts will be described in detail with respect to FIGS. 5A-6.

The storage portions 5*a* to 5*e* each having the extrusion part (pusher portions) 7*a* to 7*e* at the bottom thereof have, for example, a dispenser structure and the storage portions 5*a* to 5*e* are lifted as one push to transfer the contents from the storage portions 5*a* to 5*e* to the inlet holes 22*a* to 22*e* in a predetermined amount. Here, the extrusion parts 7*a* to 7*e* are pushed up by one push for a predetermined height and the storage portion 5*a* to 5*e*, so that the discharge amount per one push pushed out by the storage portions 5*a* to 5*e* is defined, and the number of pushes in one discharge operation can be increased or decreased according to the adjusted discharge amount.

Alternatively, the extrusion parts 7*a* to 7*e* may be configured as an ejection type piston 54 (see FIG. 6) which moves inside the storage portions 5*a* to 5*e* in a manner similar to the piston drive unit 4 described above, and an ejection driving portion which drives the respective color pistons 54. In this case, the unwinding amount can be adjusted by adjusting the rotation amount of the extrusion parts 7*a* to 7*e* (the rotation shafts 72 of the motor 71) according to the adjusted discharge amount.

The supply amount by the extrusion parts 7*a* to 7*e* is controlled by the controller 9. The control of the supply is described in detail with FIG. 7.

In the present embodiment, as illustrated in FIG. 2A, the circumference of the piston 3 and the discharge hole 15 are of the same size, and when the piston 3 is in the first position, the surface (the opening face 14) of the lowest portion of the recess 16 of the discharge face 13 and the top face (the upper face in the present embodiment) 31 of the piston 3 are substantially the same height.

Therefore, because the plurality of the contents discharged to the discharge space 2 from the inlet holes 22*a* to 22*e* are pushed out to the piston 3, all of the contents can be pushed out of the discharge container 1.

Specifically, in the discharge space 2, the contents contact only the upper surface of the piston without contacting the bottom surface 34 of the piston 3, ride on the top face 31 of the piston 3, and are conveyed to the position of the discharge face 13 of the container body 10 as the piston 3 rises.

Therefore, in the discharge operation, only the inner wall 21 of the discharge space 2 and the top face 31 of the piston 3 contact the contents. Here, because the inner wall 21 of the discharge space 2 and the side surfaces 32 of the piston 3 are in close proximity to each other, the adhered contents are also collected on the top face 31 of the piston 3 as the piston 3 moves from the second position to the first position, even if the contents are adhered to the inner wall 21 when flowing into the discharge space 2, and are pushed out to the outside at the position of the discharge face 13.

Therefore, after the discharge operation, because no contents remain inside the discharge space 2, cleaning of the inside of the discharge container 1 after the discharge operation is not necessary.

When the piston 3 remains in the first position illustrated in FIG. 2A after the discharge operation, the plurality of inlet holes 22*a* to 22*e* is closed by the piston 3 to cut off the plurality of supply passages 6*a* to 6*e* and the discharge space 2, so that the flow into the discharge space 2 of the plurality of the contents is prevented, and the state is maintained.

Accordingly, the discharge container of the present invention has no contents left in the discharge space 2 without cleaning the inside of the container, and no dust or the like is deposited. Therefore, when the discharge container is used by changing the mixing ratio during the next use, it is not necessary to perform the discharge operation without considering the mixing ratio status of the previous contents. In addition, because a plurality of holes is effectively sealed, the volatilization of the contents can be prevented except during the discharge operation.

Further, in the present embodiment, the diameter of the discharge hole 15 is consecutively with the internal diameter of the cylinder part 25 constituting the discharge space and is configured to be approximately the same size. That is, because the discharge hole 15 is configured with a dimension that can be closely adhered to the peripheral diameter of the piston 3, the contents riding on the top face 31 of the piston 3 are extruded on the top face 31 without being subjected to the pressure from the side while maintaining the same area as when the piston flowed in.

With this configuration, the user can view the movement of the contents flowing in from the inlet holes 22*a* to 22*e* and the movement of the piston 3 in the discharge space 2, so that the user can enjoy the discharge operation of the discharge container 1.

In the example illustrated in FIGS. 2A and 2B, a piston rod 35 having the shape of a female screw is provided on the lower side of the piston 3, and the rotation conveyer 45 is a male threaded bearing. However, if the piston is engaged in a screw-like manner, a male and a female screw may be opposite. That is, a male screw may be provided on the underside of the piston 3 and the rotating carrier may be a female threaded bearing.

Perspective View of Disassembled Cross Section (Modified Example)

Figure 3:
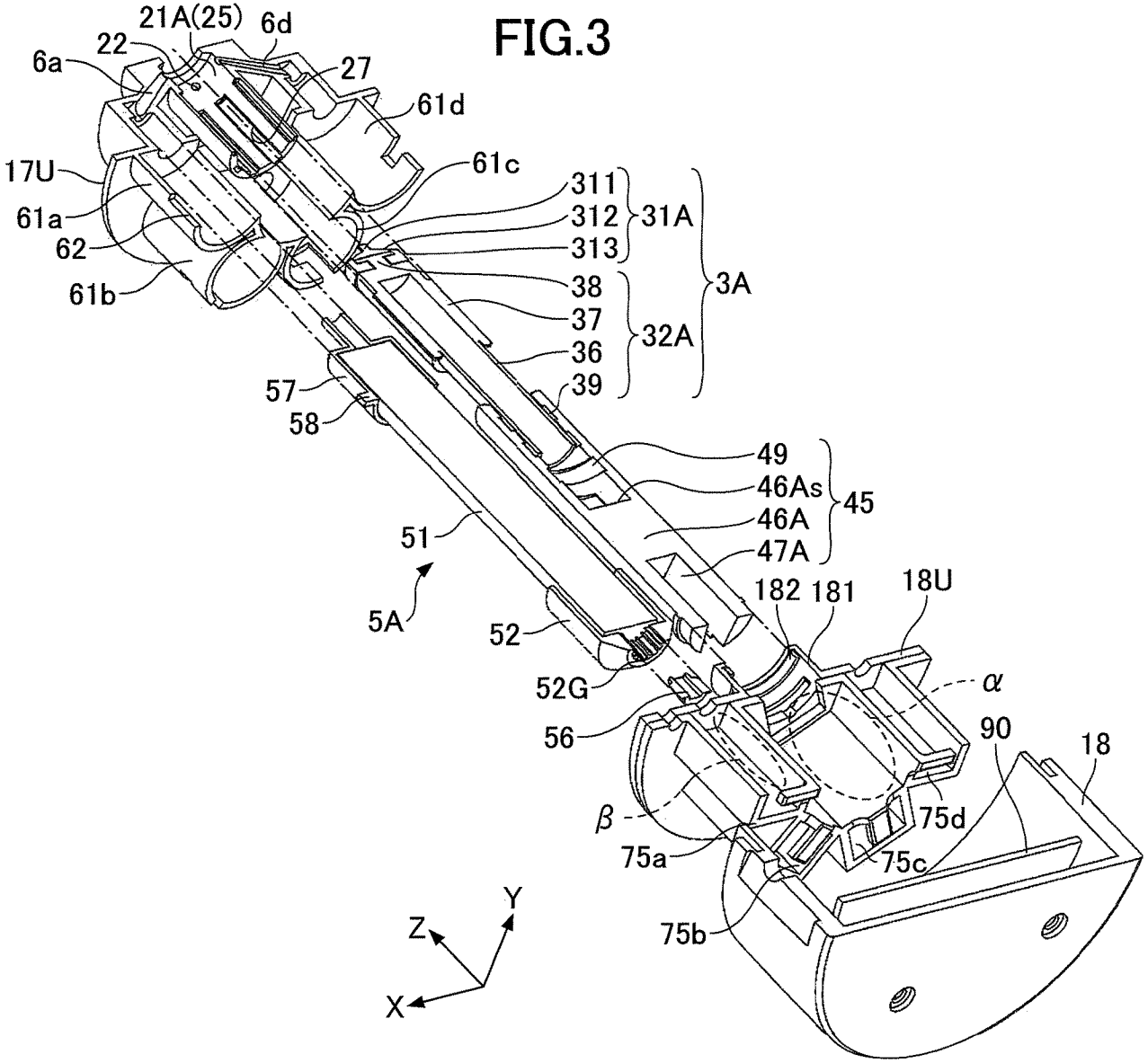
FIG. 3 is a perspective view of an internal disassembled cross-section in which a storage portion of a discharge container according to another aspect of the present invention is removed.

FIG. 3 is a perspective view illustrating an exploded cross-sectional view of an internal configuration in which a case of a discharge container 1A in which a rotation conveyer 45A is made of a female threaded bearing is removed. In FIG. 3, an example in which the piston 3A is disassembled in a first position is illustrated. In order to prevent overlap of drawings, only one storage portion and its periphery are illustrated for the storage portion 5A. The components hidden in FIGS. 2A and 2B will now be described with reference to FIG. 3.

In FIG. 3, the assembly of the +Z side illustrates the interior of the upper fixing support 17 (see FIG. 5A), and the supply passages 6*a* to 6*e* are formed below the upper plate 17U of the upper fixing support 17, the cylinder part 25, the plurality of storage portion-side holders 61*a* to 61*e*, and the cylinder part 25 and the storage portion-side holders 61*a* to 61*e* respectively.

FIG. 3 is a cross-sectional view. All of the main body side holders 61*a* to 61*e* on the storage portion side that are provided in the same number as the type of the contents are not illustrated, but only the number that can be appropriately viewed according to the angle, etc. are illustrated.

In FIG. 3, the inner wall 21A of the cylinder part 25 is illustrated as the cylinder part 25. The assembly on the −Z side also illustrates the interior of the lower fixing support 18 and is provided with a rotor bearing holder 181 having a bearing rubber 182 mounted thereon above the upper plate 18U of the lower fixing support 18.

Motor holders 75*a* to 75*e* (75*a* to 75*d* are illustrated) are provided below the upper plate 18U of the lower fixing support 18. An extruder motor 7*a* (see FIG. 6) shall be installed in the internal space β of the motor holder 75*a* to 75*e*.

Although not illustrated, a piston motor 41 (see FIGS. 2A and 5B) is installed in the central space α surrounded by the motor holders 75*a* to 75*e*, and the piston motor 41 is connected to the bearing hole 48 of the rotation conveyer 45A via a bearing held in the rotary bearing holder 181.

In this configuration, an example in which a convex portion 311 is formed in the center of an end surface of the piston 3A at the discharge hole side (in FIG. 3, a surface at the +Z side). In this configuration, piston 3A has a top face 31A and a cylindrical portion 32A.

The top face 31A has a convex portion 311 and a front side portion (a flat portion) 312 around the convex portion 311 as a portion in contact with the contents. Further, in the example illustrated in FIG. 3, the inlet hole 22 is blocked by the distal side portion 313 which is a side of a portion other than the convex portion 311 of the top face 31A. Therefore, the top face 31A is made of a soft material such as NBR, silicone rubber, thermoplastic elastomer, and the like as well as the seal portion 33 of FIG. 2B. The cylindrical portion 32A of the piston 3A is made of, for example, HDPE or PP.

In the example illustrated in FIG. 3, in the cylindrical portion 32A of the piston 3A, the distal end of the cylindrical portion 36 is provided with an engagement projection 38 for engaging the top face 31A.

The inner wall 21A of the cylinder part 25 on the +Z side of FIG. 3 has a plurality of stretching grooves 27 extending along the vertical direction of the piston 3A in the direction of travel. Correspondingly, the outer peripheral surface of the cylindrical portion 36 of the piston 3A is provided with a plurality of elongated projections 37 which engage the elongated grooves 27.

Further, the rotation conveyer 45A illustrated in FIG. 3 has an H-shaped female threaded bearing shape, the distal end of the piston 3A has a female threaded configuration, and a rotation groove 49 is formed in the inner wall. Correspondingly, a helical projection 39 is formed as a transmission portion under the outer circumference of the cylindrical portion 36 of the piston 3A. In addition, in the rotation conveyer 45A, the end face of the female threaded portion in which the rotation groove 49 is formed functions as a stopper face 46As.

In this configuration, the piston 3A is rotated from the H-shaped rotating carrier 45A by helical engagement, and the elongated projection 37 of the piston 3A moves along the elongated groove 27 within the inner wall 21A of the cylinder part 25 so that the piston 3A moves in the desired direction of progression without rotating and while the position is regulated.

The main body cylinder 51 of the storage portion 5A is retained by a storage portion holder 57 having a fixed projection 58. Meanwhile, the bearing 56 fits into the fitting protrusion 52G formed inside the operation cylinder portion 52 of the storage portion 5A, and the rotation shaft 72 (see FIG. 6) of the extrusion part (extrusion drive part) 7A is inserted into the bearing 56.

A fixed projection 58 is formed in a storage portion holder 57 for holding main body cylinder 51. Correspondingly, a groove 62 extending in up and down directions are formed in the main body side holder 61 (61*a* to 61*e*).

When the fixed projection 58 of the holder 57 engages the groove 62 of the main body side holder 61, the main body cylinder 51 is fixed even when the operation cylinder 52 rotates. Therefore, the contents are pushed out into the inlet holes 22*a* to 22*e* through the supply passages 6*a* to 6*e* due to the relative rotation of the operation cylinder 52 with respect to the main body cylinder 51.

<Operation Procedure>

Next, an operation procedure of the discharge container 1 of the present invention will be described.

Figure 4:
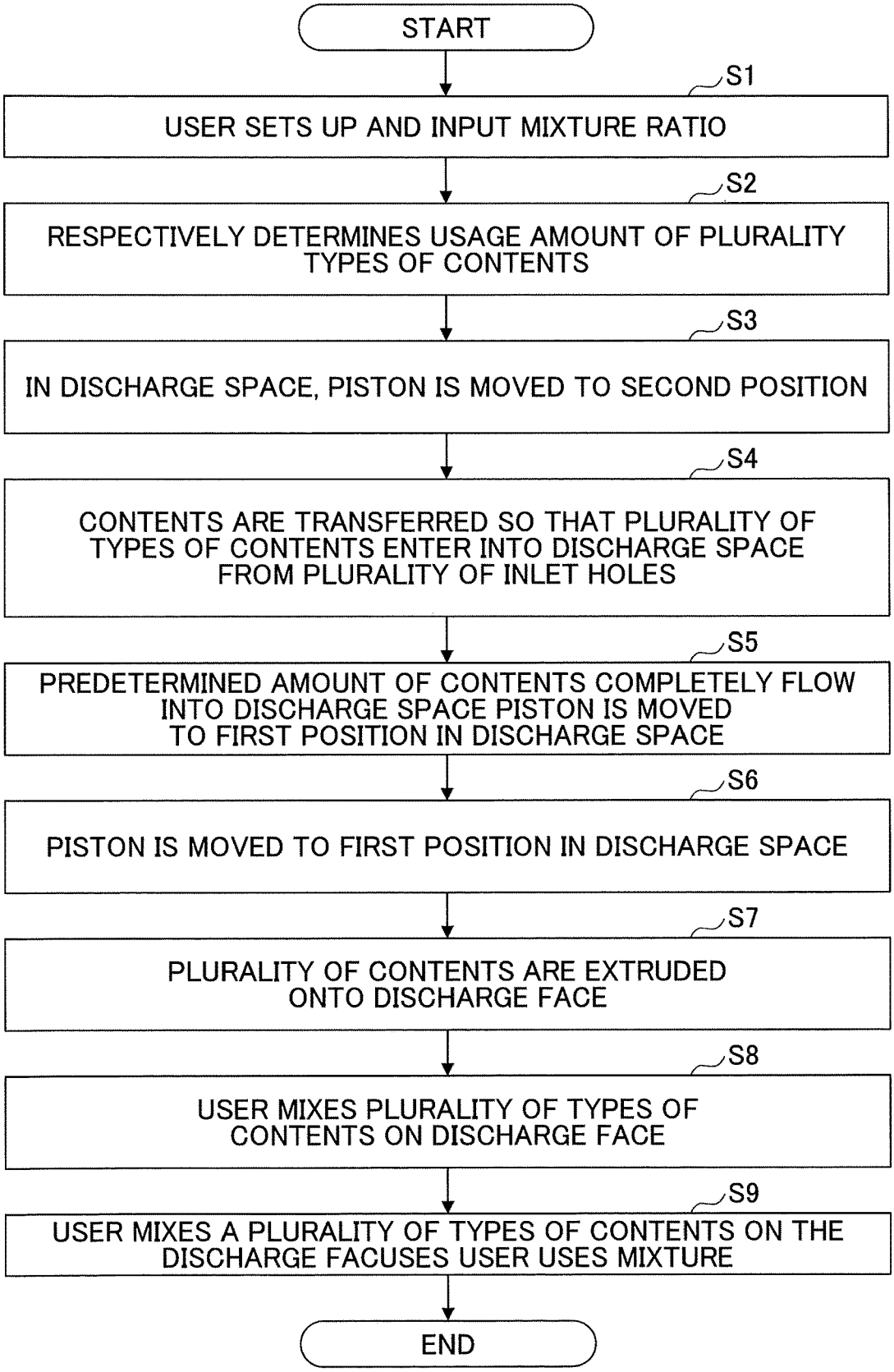
FIG. 4 is a flowchart illustrating the operation of the discharge container according to the present invention.

FIG. 4 is a flow chart illustrating the operation of the discharge container of the present invention. The flow procedure is preset by a program stored in the controller 9.

In step S1 of FIG. 4, the user sets the mixing ratio of the contents and enters it into an instruction unit. In this embodiment, the instruction unit is an operation unit 101. However, as will be described later, a user may input information through an information processing terminal connected by a network.

In step S2, the controller 9 determines a usage amount (discharge amount) of the plurality types of the contents based on the mixing ratio that is predetermined.

In step S3, in the discharge space 2, the piston 3 is moved from the first position to the second position. That is, in the discharge space 2, the piston 3 moves from a position in which the inlet holes 22*a* to 22*e* of the inner wall 21 of the cylinder part 25 are blocked to a position in which the inlet holes 22*a* to 22*e* are blocked, to a position in which the lower surface portion contacts the stopper 26 (or the stopper face 46As) and the inlet holes 22*a* to 22*e* are opened.

After step S3, in step S4, the contents are transferred, so that a plurality of types of the contents enter into the discharge space 2 from a plurality of inlet holes 22*a* to 22*e*.

Figure 6:
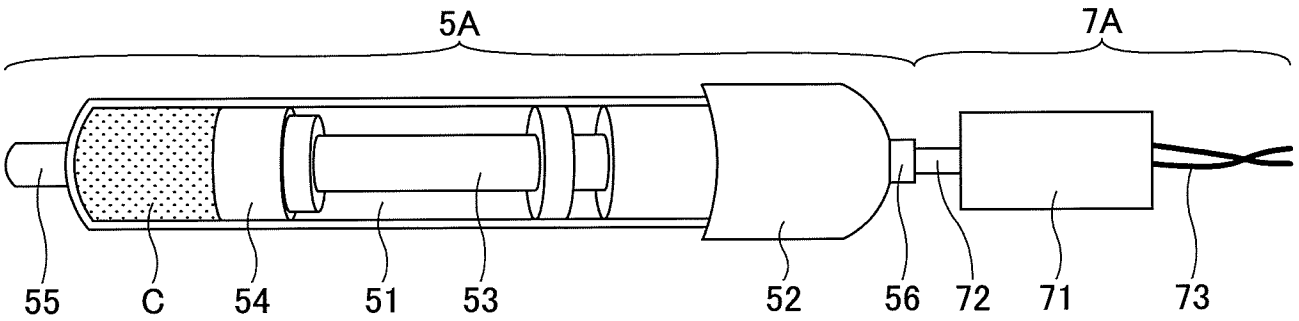
FIG. 6 is a view illustrating one of storage portions of the extrusion type and a transmission system of an extrusion part.

In step S4, as illustrated in the examples of FIGS. 2A and 2B, in the case of an feed type extrusion part of the dispenser type, the extrusion part 7*a* to 7*e* push the contents from the storage portions 5*a* to 5*e* by pushing the storage portions 5*a* to 5*e* from the bottom toward the inlet holes 22*a* to 22*e*. Otherwise, in the case of the ejection type, as illustrated in the examples of FIGS. 3 and 6, the extruder (extrusion drive unit) 7A pushes the contents in the storage portion 5A toward the inlet holes 22*a* to 22*e* by pushing the contents in the storage portion 5A by each color piston 54 which is raised by rotation. Otherwise, in a case of a suction way, as in the second embodiment which will be described later, the contents may be moved from the storage portions 50*a* to 50*e* (see FIGS. 9A and 9B) to the inlet holes 22*a* to 22*e* by the pumps 8*a* to 8*e* in the supply passages 60*a* to 60*e*.

For example, when the viscosity of the contents is high, an extrusion way is used, and when the viscosity is low, a pump way is used to move the contents.

Immediately after the start of use, the contents fed at the time of the previous use may reach the inlet holes 22*a* to 22*e* or the vicinity of the inlet holes 22*a* to 22*e*. Therefore, other than immediately after the start of use, the inlet holes 22*a* to 22*e* of the inner wall of the cylinder part 25 are opened by the movement of the piston 3 in step S3, and the contents are transferred by a transfer unit, so that the contents of the plurality of types immediately flow from the plurality of inlet holes 22*a* to 22*e* into the discharge space 2.

At this time, the inlet from the plurality of inlet holes 22*a* to 22*e* to the discharge space 2 may be flowed simultaneously between the plurality of the contents, or the inlet from one or the plurality of the contents may be flowed at the respective timings in order.

When a plurality of contents of a plurality of types enter the discharge space 2 in a predetermined amount (step S5), in step S6, the piston 3 is moved from a second position to a first position in the discharge space 2.

As the piston 3 of step S6 moves, the plurality of contents in the discharge space 2 ride on the top face 31 of the piston 3 and are extruded to the same height as the discharge face 13 of the container body 10 (step S7).

Then, the user mixes a plurality of types of contents on the discharge face 13 (step S8) and uses the mixture (step S9).

In this embodiment illustrated in FIGS. 1-2B, because the plurality of contents are not mixed and reach the same position as the discharge face 13 of the container body 10 on the top face 31 of the piston 3 without being pressurized in the discharge space 2, a user can enjoy mixing the contents by himself or herself. In this case, in the first embodiment, a recess 16 is formed in the discharge face 13 which is the upper surface of the container body 10, at a portion surrounding the discharge hole 15. Therefore, when the user mixes a plurality of extruded contents more inside the edge of the recess 16 with the recess 16 as a tray, the user can efficiently use the mixture.

In addition, after the above flow, when a mixture is deposited on the discharge face 13 outside the discharge container 1, it is more preferable for the user to wipe off the adhered material with tissue or the like, as appropriate.

Figure 5A:
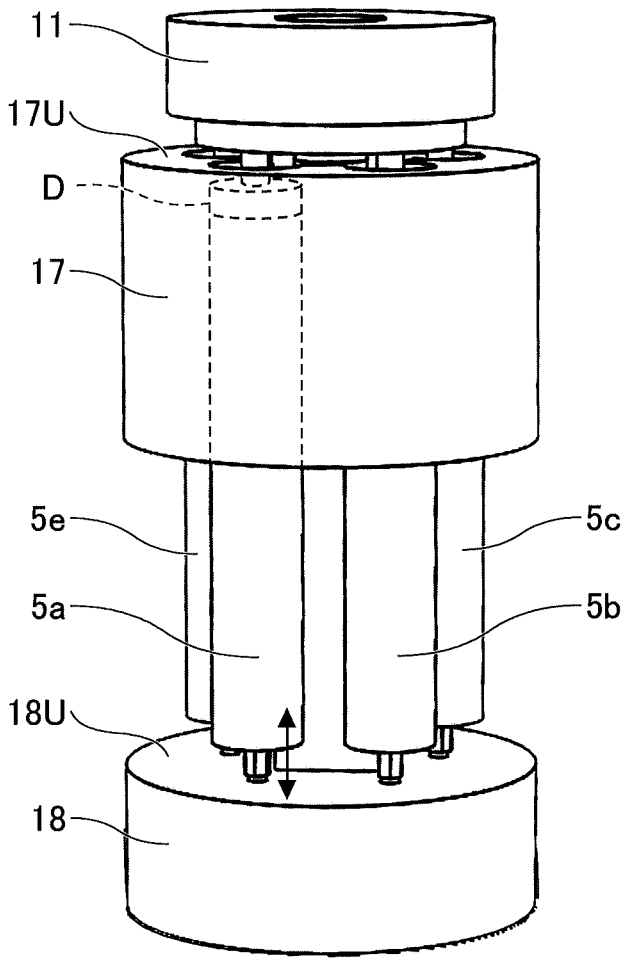
FIG. 5A is a side view of a plurality of storage portions of an extrusion type with the receiving cylinder of the discharge container removed.
Figure 5B:
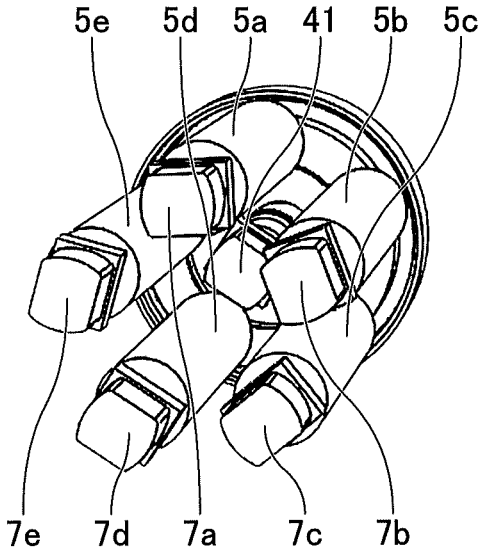
FIG. 5B is a view illustrated from another angle with the fixing support omitted from FIG. 5A.

Internal extrusion part inside the container FIGS. 5A and 5B are diagrams illustrating the configuration of a plurality of extrusion part-type storage portion in which the receiving cylinder 12 of the discharge container 1 is removed. Specifically, FIG. 5A is a side view of a plurality of extrusion receptacles with the receiving cylinder 12 of the discharge container 1 removed, and FIG. 5B is a view viewed from another angle with the fixing supports 17 and 18 removed from FIG. 5A.

As described above, in this embodiment, the discharge container 1 is provided with five storage portions 5*a* to 5*e*, the extrusion parts 7*a* to 7*e*, and the supply passages 6*a* to 6*e*.

The inside of the receiving cylinder 12 is provided with a fixing support 17 for fixing the position of the tubular supply passages 6*a* to 6*e* in the vertical direction and the circumferential direction at the upper side, and a fixing support 18 for fixing the position of a part of the cylindrical storage portions 5*a* to 5*e* and the positions of the extrusion parts 7*a* to 7*e* at the lower side.

In FIG. 5A, the upper side of the cylindrical storage portions 5*a* to 5*e* is provided with a dispenser part D of an upper discharge type, which is discharged upward by a push inside the fixing support 17. In FIG. 5A, only the dispenser part D mounted to the storage portion 5*a* is illustrated. However, the dispenser part is similarly provided at the upper part of the other storage portions 5*b* to 5*f*.

Here, the extrusion parts 7*a* to 7*e*, which are the push-up portions, are provided in a straight lines at the lower sides of the cylindrical storage portions 5*a* to 5*e*, and the cylindrical storage portions 5*a* to 5*e* are pushed up from the lower side to the upper side, so that the pump function of the dispenser D fixed to the inside of the fixing support 17 is activated.

The contents accommodated in the storage portions 5*a* to 5*e* are absorbed by the dispenser D in a predetermined amount per a push by the extrusion parts 7*a* to 7*e* and pushed up into the supply passages 6*a* to 6*e* formed in the discharging cylinders 11 on the upper side.

As illustrated in FIG. 5B, the storage portions 5*a* to 5*e*, the extrusion parts 7*a* to 7*e*, and the supply passages 6*a* to 6*e* are integrally provided in the discharge container 1. Therefore, when the contents are lost, the cartridge including "the storage portion+the extrusion part+the supply passage" is replaced as a unit.

[Extending Transfer Mechanism]

FIG. 6 illustrates a drawing in which one of an extending type extrusion way storage portion 5A and an extrusion part (extending drive part) 7A having a different configuration from FIG. 5 are drawn out.

The storage portion 5A includes a main body cylinder 51 as a storage case and an operation cylinder 52 connected to the main body cylinder 51. Inside the main body cylinder 51 and the operation cylinder 52, a movable body 53 is contained so as to penetrate thereto.

The main body cylinder 51 includes a filling area in which the contents C are filled.

The operation cylinder 52 is disposed at a rear end of the main body cylinder 51 in a relative rotation manner. When the operation cylinder 52 is rotated relative to the main body cylinder 51, the main body cylinder 51 and the movable body 53 contained in the operation cylinder 52 move forward (in the left direction in FIG. 6), and when each color piston 54 provided at the distal end of the movable body 53 moves forward, the contents C are pushed out toward the distal end. As a result, the contents C are pushed into the supply passage 6 (6*a* to 6*e*) (see FIGS. 2A and 3) mounted to the diameter small portion 55 through the diameter small portion 55 at the distal end of the main body cylinder 51.

In this configuration, the axial movable body 53 does not penetrate the piston 54, but exists only on the lower side of the piston 54 (the rear end side, to the right side of FIG. 6). Accordingly, the upper contents C of the piston 54 can be extruded without adhering to the movable body 53 because the movable body 53 is not present on the upper side of the piston 54 (the distal end (the left side of FIG. 6).

Further, because there is no movable body 53 on the upper side of the main body cylinder 51, the periphery of the small portion 55 on the upper side of the main body cylinder 51 can have a simple configuration. Therefore, when the diameter small portion 55 is inserted into the supply passages 6*a* to 6*e* through which the opening formed on the lower surface of the discharging cylinder portion 11 of the size suitable for the diameter small portion 55 is inserted, the contents C are pushed out by the piston 54 transmitting power from the lower side, without requiring a power source or a power transmission member on the side of the discharging cylinder portion 11 at the top face portion of the container body 10.

As illustrated in FIG. 3, the main body cylinder 51 is fixed by a storage portion holder 57 and a main body side holder 61 with respect to the receiving cylinder 12 regulated in rotation in a circumferential direction.

Meanwhile, a bearing 56 is provided in the tail plug portion which is at the lower end of the operation cylinder 52 and has a small inside diameter. A rotation shaft (output shaft) 72 of a motor 71 constituting an extrusion part 7A is connected to a bearing 56.

In the present configuration example, because the motor 71, which is an extrusion part of the acceleration type, is provided in a straight line under the storage portion 5A, when the motor 71 is set as illustrated in FIG. 3 and is mounted upright as illustrated in FIG. 1, power is directly transmitted from the bottom to the operation cylinder 52 in the storage portion 5A. That is, when power is supplied from the wiring 73 and the motor 71 of the extrusion part 7A rotates the rotation shaft 72, the rotation force is transmitted to the operation cylinder 52 through the bearing 56, and the operation cylinder 52 rotates relative to the main body cylinder 51, so that each color piston 54 rises and the contents C is pushed out from the upper diameter small portion 55 to the supply passage 6.

In the extrusion part configuration of FIG. 6, it is possible to extrude a material having a higher viscosity than the contents used in the extrusion part configuration of the dispenser of FIG. 5A.

[Controller]

FIG. 7 is an example of a control block diagram of the discharge container 1.

Here, a configuration in which a plurality of contents is a cosmetic agent having five different colors will be described. In the present example, a five-color cosmetic agent is illustrated as a cyan, magenta, yellow, black, or white cosmetic agent used in, for example, a point cosmetic agent.

A piston motor 41 for driving the piston 3 is provided as a part of the piston drive unit 4. A cyan motor 7*a*, a magenta motor 7*b*, a yellow motor 7*c*, a black motor 7*d*, and a white motor 7*e*, which are extruding portions (pushing portions) for extruding the contents from each of the storage portions 5*a* to 5*e*, and a dispenser portion D for extruding the contents by pushing by these motors are provided as an extrusion part type transfer unit. Alternatively, in the case of the unwinding type illustrated in FIG. 6, a motor 71 constituting the extrusion part (extrusion drive part) 7A drives and rotates the piston, and each color piston 54 is provided as an extrusion type transfer unit to push the contents up.

The control board 90 constituting the controller 9 includes a power supply 91, a main control unit 92, a piston control unit 93, and a supply control unit 94.

The power supply 91 is a source of power for the entire discharge container 1 and is controlled by the power switch 103.

The piston control unit 93 drives a piston motor 41.

The supply control unit 94 sets the respective supply amounts of the plurality of contents that flow into the discharge space 2 through the plurality of supply paths and the plurality of inlet holes from the plurality of storage portions. The supply control unit 94 includes a mixing/discharge amount setting unit 95 and a parameter converting unit 96.

The mixing/discharge amount setting unit 95 sets the mixing ratio of a plurality of contents based on the instruction of the information on the mixing and sets the supply amount of each of the plurality of contents.

The parameter converting unit 96 converts the respective supply amount of the set plurality of contents to a parameter. For example, the supply amount (the extrusion transfer amount) of the plurality of contents is adjusted by controlling the number of operation pushes and the operation time of each color motor (the extrusion part) 7*a* to 7*e* as the transfer unit as parameters. Then, based on the set parameters, power is supplied to each color motors 7*a* to 7*e* that are the extrusion part transfer unit.

The main control unit 92 adjusts the timing for operating the supply control unit 94 and the piston control unit 93.

The piston control unit 93 promptly supplies power to the piston motor 41 after receiving an instruction from the operation unit 101 to move the piston 3 from the first position to the second position.

The supply control unit 94 drives the extrusion part (motors 7*a* to 7*e*) at a timing after the piston 3 moves to the second position to feed the set plurality of contents into the discharge space 2.

The piston control unit 93 supplies power to the piston motor 41 and moves the piston 3 from the second position to the first position at a timing after the set plurality of contents are supplied to the discharge space 2.

The operation unit 1011 is an instruction receiving unit according to the present embodiment and receives an instruction of information regarding the mixture of a plurality of contents. The light emitting unit 102 emits light to indicate the current state operated by the power switch 103 and the operation unit 101. The power switch 103 turns the power supply 91 on and off.

Second Embodiment

Figure 8:
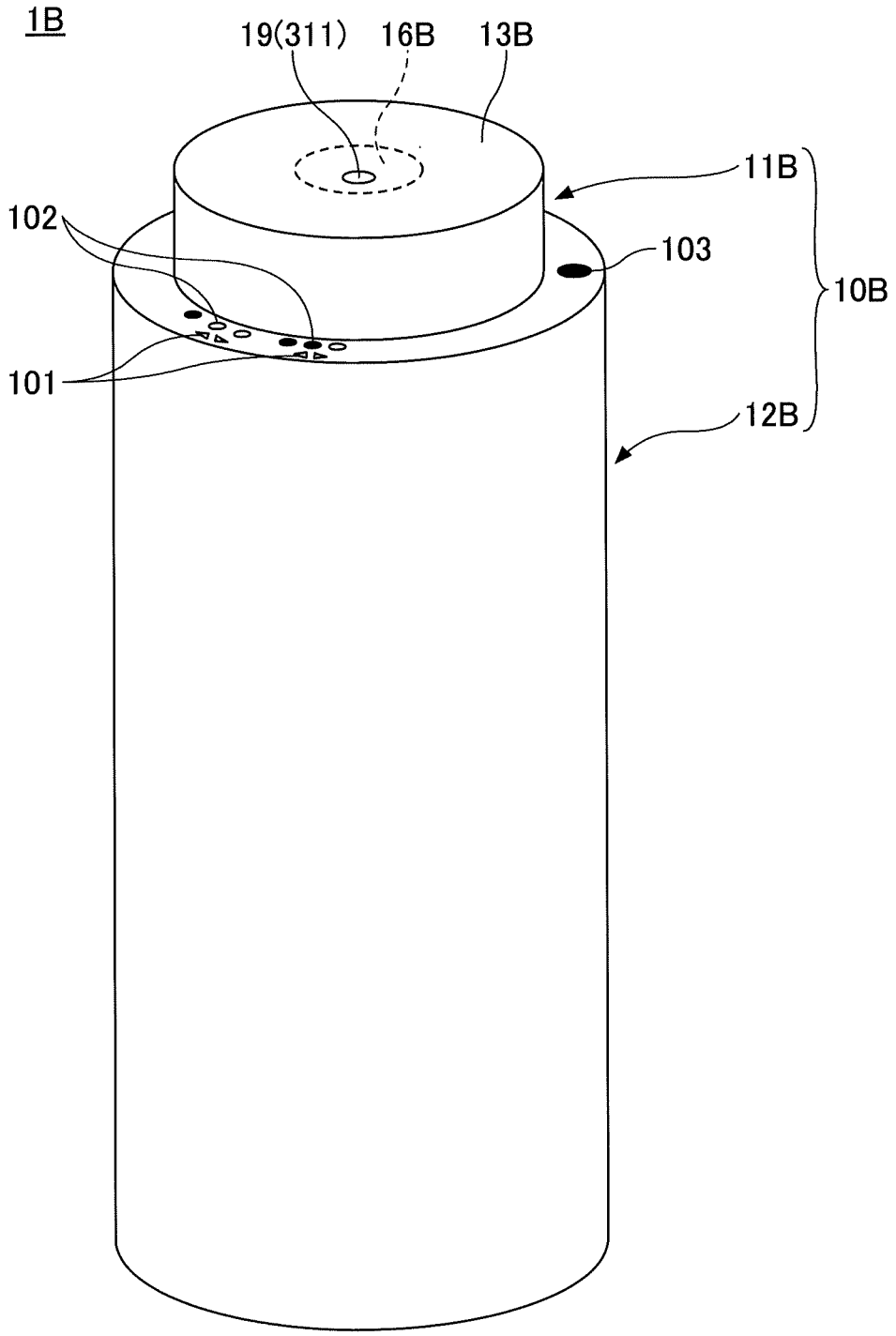
FIG. 8 is an overall view of a discharge container according to a second embodiment of the present invention.

FIG. 8 is an overall view of the discharge container 1B according to a second embodiment of the present invention.

Figure 9A:
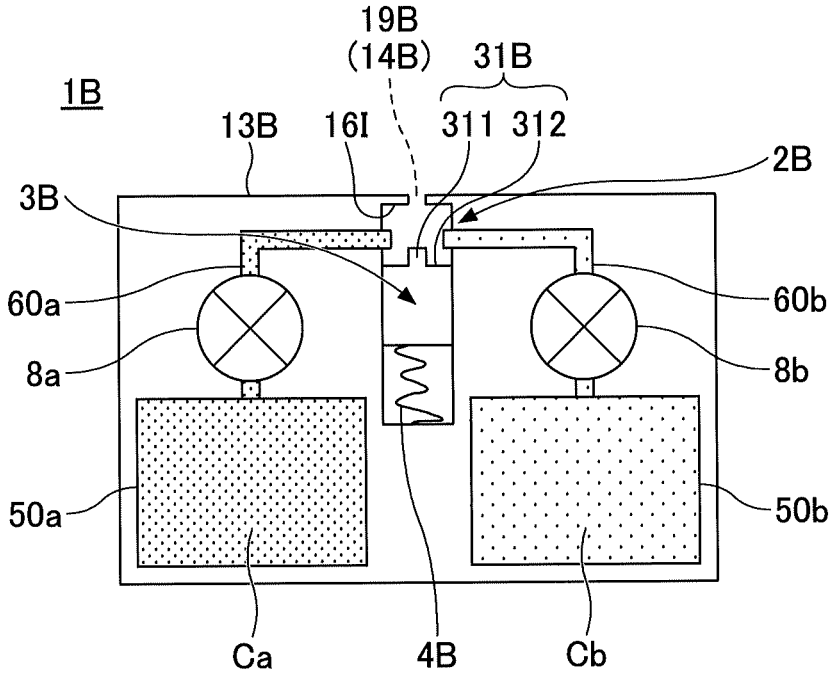
FIG. 9A is an example of an internal schematic diagram of the discharge container according to the second embodiment of the present invention, in which a piston is in a second position.

In this embodiment, the diameter of the discharge hole 19 is smaller than the circumferential diameter of the piston 3B (see FIG. 9A). Similar to the configuration example illustrated in FIG. 3, a convex portion 311 is formed in the center of the top face 31B that is an end surface of the discharge hole side of the piston 3B (see FIG. 9A).

When the piston 3B of this embodiment is at the first position, the top face of the convex portion 311 of the piston 3B is substantially the same as the opening face 14B of the discharge hole 19 (see FIG. 9A) or higher than the opening face 14B.

[Internal Schematic View]

Figure 9B:
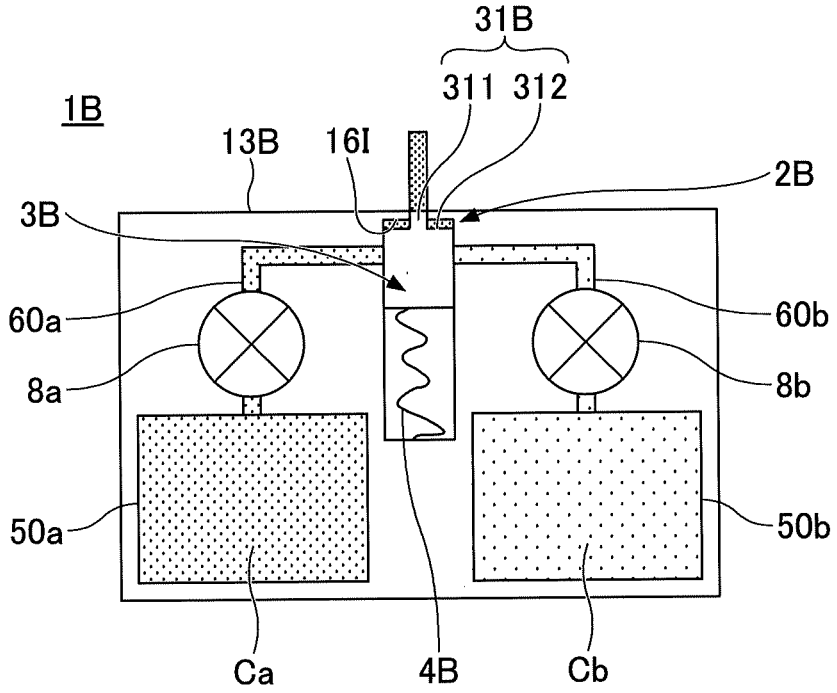
FIG. 9B is a view illustrating a state in which the piston of the discharge container illustrated in FIG. 9A is directed from a second position to a first position.

FIGS. 9A and 9B are an internal schematic views of the discharge container 1B of FIG. 8, wherein FIG. 9A illustrates a state where the piston 3B is in a second position and FIG. 9B illustrates a state where the piston 3B is moving from a second position to a first position.

As illustrated in FIG. 9A, the discharge space 2B, the piston 3B, the plurality of storage portions 50*a* and 50*b*, the supply passages 60*a* and 60*b*, and the pumps 8*a* and 8*b* are provided inside the discharge container 1B according to the present embodiment. The discharge space 2B communicates with the discharge hole 19 formed in the discharge face 13B.

Referring to FIG. 9B, when the piston 3B is in the first position, the top face of the convex portion 311 of the piston 3B is substantially at the same position as the opening face 14B of the discharge hole 19, and the distal face portion 312 other than the convex portion of the piston 3B is at a height that abuts the inner side surface (lower surface) 161 of the discharge face 13B or the recess 16. The distal face portion 312 of the piston 3B may have a shape corresponding to the inner surface shape of the discharge face 13B, be a plane surface as illustrated in FIG. 9B, be inclined so as to be high toward the convex portion 311 of the central portion as illustrated in FIG. 3, or be inclined so as to be low toward the convex portion 311.

As described above, in this embodiment, because the diameter of the discharge hole 19 is small, a plurality of types of the contents discharged are conveyed onto the discharge face 13B after receiving pressure. Therefore, in the discharge container 1B according to the present embodiment, the contents are extruded while being mixed slightly. Accordingly, the user can enjoy the gradual injection of a slightly mixed discharge, and can reduce the time required for the mixing of the contents extruded from the discharge hole on the discharge face 13B.

In the example of FIGS. 9A and 9B, the pumps 8*a* and 8*b* are used as a method of supplying the contents Ca and Cb from the storage portions 50*a* and 50*b* to the discharge space 2B. The pumps 8*a* and 8*b* are provided in each of the supply paths of the plurality of supply paths.

In this example, there are two examples of the storage portions 50*a* and 50*b*, the corresponding pumps 8*a* and 8*b*, and the supply passages 60*a* and 60*b*. However, the number of storage containers may be any as long as plural.

The pumps 8*a* and 8*b* are suction type transfer unit which adjusts the supply amount of each contents Ca and Cb flowing into the discharge space 2B from each of the storage portions 50*a* and 50*b*, draw each contents Ca and Cb from each of the storage portions 50*a* and 50*b* in each of the supply passages 60*a* and 60*b*, and transfer them to the inlet holes 22*a* and 22*b*.

Further, the pumps 8*a* and 8*b* are adjusted by the above-described supply control unit 94 to adjust the supply amounts of the respective contents Ca and Cb from the respective receiving units 50*a* and 50*b* to adjust the ratio of the plurality of contents when they are discharged from the discharge hole 19. The supply control unit 94 converts the respective supply amount of the set plurality of contents that are set into a parameter. For example, as the parameter, the suction amounts of the pumps 8*a* and 8*b*, which are the suction type transfer unit, are controlled to adjust the supply amounts (the suction transfer amount) of the plurality of the contents Ca and Cb.

In the discharge operation according to this embodiment, by moving the piston 3B to the second position, a plurality of inlet holes 22*a* and 22*b* are opened, a plurality of supply passages 60*a* and 60*b* are in communication with the discharge space 2B, and a plurality of contents Ca and Cb are flowed into the discharge space 2B from the supply passages 60*a* and 60*b* by the pumps 8*a* and 8*b*.

Thereafter, the piston 3B is moved to the first position to push a plurality of contents flowing into the discharge space 2B out of the discharge hole 19 to the discharge container 1B.

In this embodiment, a configuration using a suction way transfer driving method using the pumps 8*a* and 8*b* as a transfer method of a plurality of contents using a discharge hole 19 having a diameter smaller than the diameter of the discharge space 2B as the discharge hole has been described. However, the combination of the discharge hole and the supply method is not limited thereto.

For example, the discharge hole 19 having a diameter smaller than the diameter of the discharge space 2B illustrated in FIG. 8 may be used as the discharge hole, and the extrusion parts 7*a* to 7*e* and 7A (a transfer drive with a dispenser type extrusion part or an extending type extrusion part) may be used as the transfer method of the contents as illustrated in FIG. 5A or FIG. 6. Alternatively, as illustrated in FIG. 1, the discharge hole 15 having a diameter substantially the same as that of the discharge space 2 may be used as the discharge hole, and the pumps 8*a* and 8*b* (suction way transfer driving) may be used as the transfer type of the contents as illustrated in the center portions of FIG. 9A and FIG. 9B.

Examples of Modes of Use (Third Embodiment)

Figure 10:
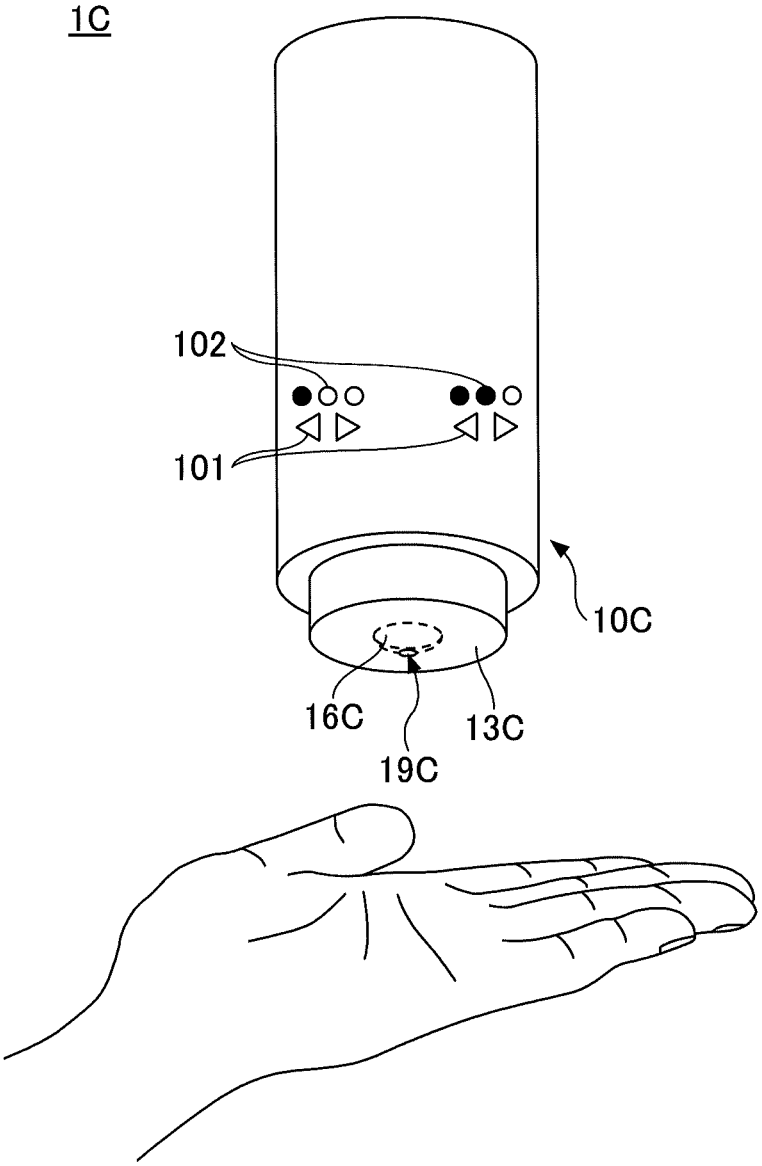
FIG. 10 is a view illustrating another use state of the discharge container according to a third embodiment of the present invention.

FIG. 10 is a diagram illustrating another use state of the discharge container of the present invention.

In the above-described embodiment, an example in which the discharge containers 1, 1A, and 1B are disposed to be discharged upwardly is illustrated. However, in the discharge container of the present invention, the direction of discharge is not limited to the upward direction but may be the downward direction as illustrated in FIG. 10.

As illustrated in FIG. 10, when the discharge container 10 is arranged so as to be discharged downward, the contents may be discharged onto the hand of the user and mixed together on the palm of the hand, as in the case of a hand wash which is fixedly installed.

It is preferable that the operation unit 101 and the light emitting unit 102 are disposed at a suitable position for easy viewing, such as a side surface, so that the operation unit 101 is visible to the user.

In this embodiment, the discharge face 13C on which the discharge hole 19C is formed is the lower surface of the container body 100, as an example. Therefore, the piston inside the container can be moved up and down between the first position below and the second position above. In this configuration, when the power supply is turned OFF, or when the piston is in the discharge and standby positions, the piston is in the first position below, and the surface of the discharge face (lower surface) 13C and the lower surface of the piston are at approximately the same height.

Here, when discharging the contents in the downward direction in the discharge container 10, it is preferable that the contents have a high viscosity in consideration of gravity. In view of gravity, it is preferable that the configuration be smaller than the diameter of the discharge space communicated by the discharge hole 19C as illustrated in FIG. 8.

Further, as illustrated in FIG. 10, when discharging is performed in a downward direction, it is preferable that the circumference of the discharge hole 19C is not a structure in which the discharge hole 19C is concave as in the first and second embodiments, but a convex portion 16C protruding in a mountain-like manner from the discharging surface 13C.

In FIG. 10, a configuration to be discharged downwardly is illustrated, but the direction of discharge is not limited to the upward and downward directions but may be a lateral direction.

<Modification>

Further, although described above is the discharge container of the above embodiment in an example where the piston is automatically raised and lowered, the piston may be raised and lowered manually.

For example, in the discharge container in which the piston is manually operated, when the transfer unit transfers the contents corresponding to the predetermined number of pushes, the rotation amount of the operation cylinder, and the amount of suction, which are used for one discharge, and a predetermined amount of the plurality of the contents is flowed into the discharge space, the transfer unit notifies the discharge space to that effect by sound or light. Then, a user pushes a button or pulls up or down a projection connected with the piston to move the piston and discharge the plurality of contents.

<Customized Discharge System>

Figure 11:
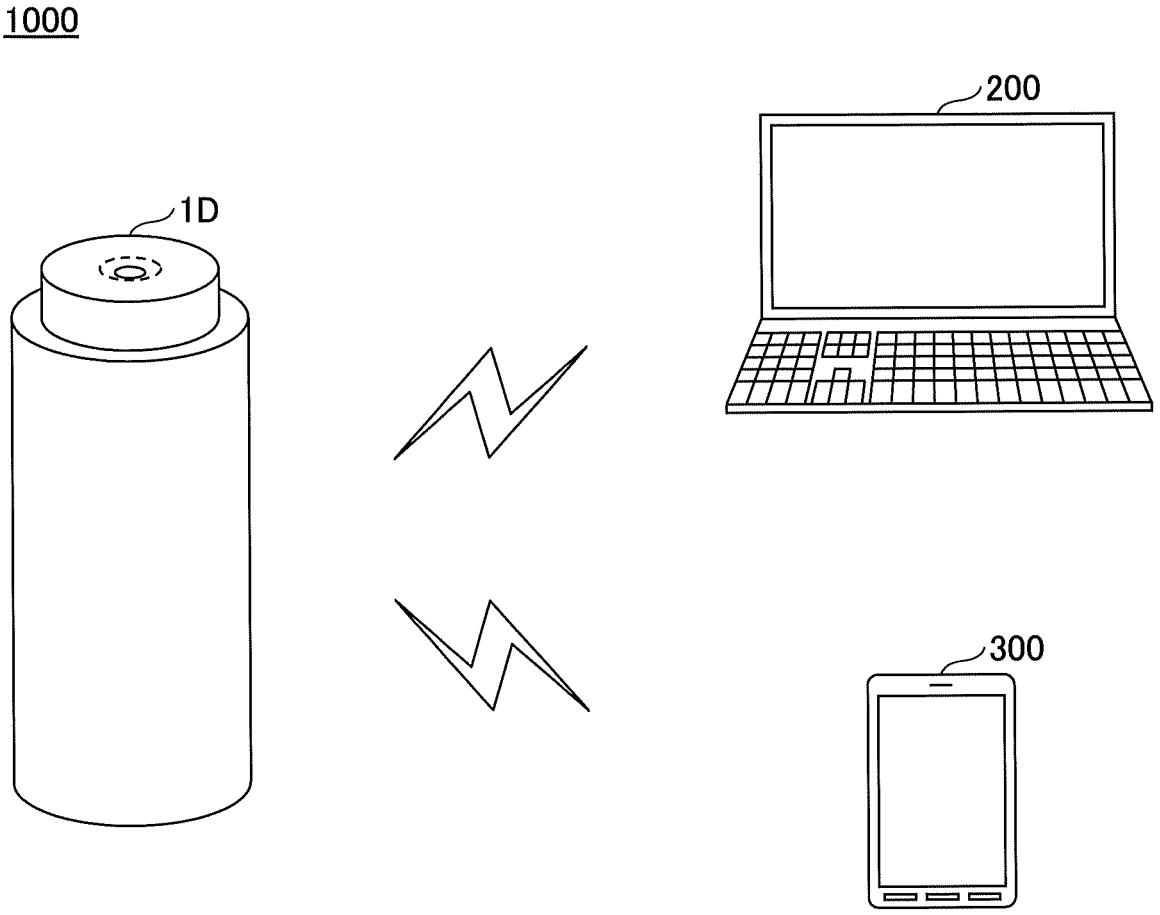
FIG. 11 is a schematic diagram of a customized discharge system including a discharge container according to a fourth embodiment of the present invention.

FIG. 11 is a schematic diagram of a customized discharge system including a discharge container according to a fourth embodiment of the present invention.

In the above-described embodiment, the user instructed the discharge amount (mixing ratio) by the operation unit 101 provided in the container body 10.

However, in the discharge container 1D according to the fourth embodiment of the present invention, it is possible to receive an instruction of information concerning the mixture of a plurality of contents from an information processing terminal which is an external device capable of communicating with the discharge container 1D via a network.

According to this embodiment, a communication unit 97 (see FIG. 12) is provided at a part of the control board 90D of the discharge container 1D, and the communication unit 97 is capable of communicating with a computer 200 or a smartphone 300 that is an information processing terminal.

For example, the information processing terminals 200 and 300 have an instruction reception function for receiving an instruction of information on the mixture of a plurality of contents of the discharge container 1D by downloading an application in advance or the like.

Accordingly, the user inputs information concerning the discharge amount (mixing) of the discharge container to the information processing terminal 200,300.

According to this embodiment, the discharge container 1D and the information processing terminals 200 and 300 are called the customized discharge system 1000 in combination.

Although only the appearance of the discharge container 10 is illustrated in FIG. 11, the discharge container 1D includes, for example, a container body, a piston movable in the discharge space, a plurality of storage portions, a plurality of supply passages, a pushing type or extending type, extrusion way or suction way, transfer unit, a controller, and so on in a manner similar to any of the first to third embodiments described above, in the present embodiment. A plurality of inlet holes corresponding to the plurality of storage portions are famed in the inner wall of the discharge space, for example.

The discharge container 1D sets the supply amount of each of the plurality of contents that flows from the plurality of the information processing terminals 200 and 300 into the discharge space through the plurality of supply paths and the plurality of inlet holes based on the instruction of the mixing information input to the information processing terminals 200 and 300.

In FIG. 11, an example in which an operation unit is not provided in the discharge container 1D that can be communicated is illustrated. However, in the discharge container, an operation unit may be further provided in the discharge container that can be communicated in order to be operated even at hand in addition to instructions from the information processing terminals 200 and 300.

[Control block of Customized Discharge System]

Figure 12:
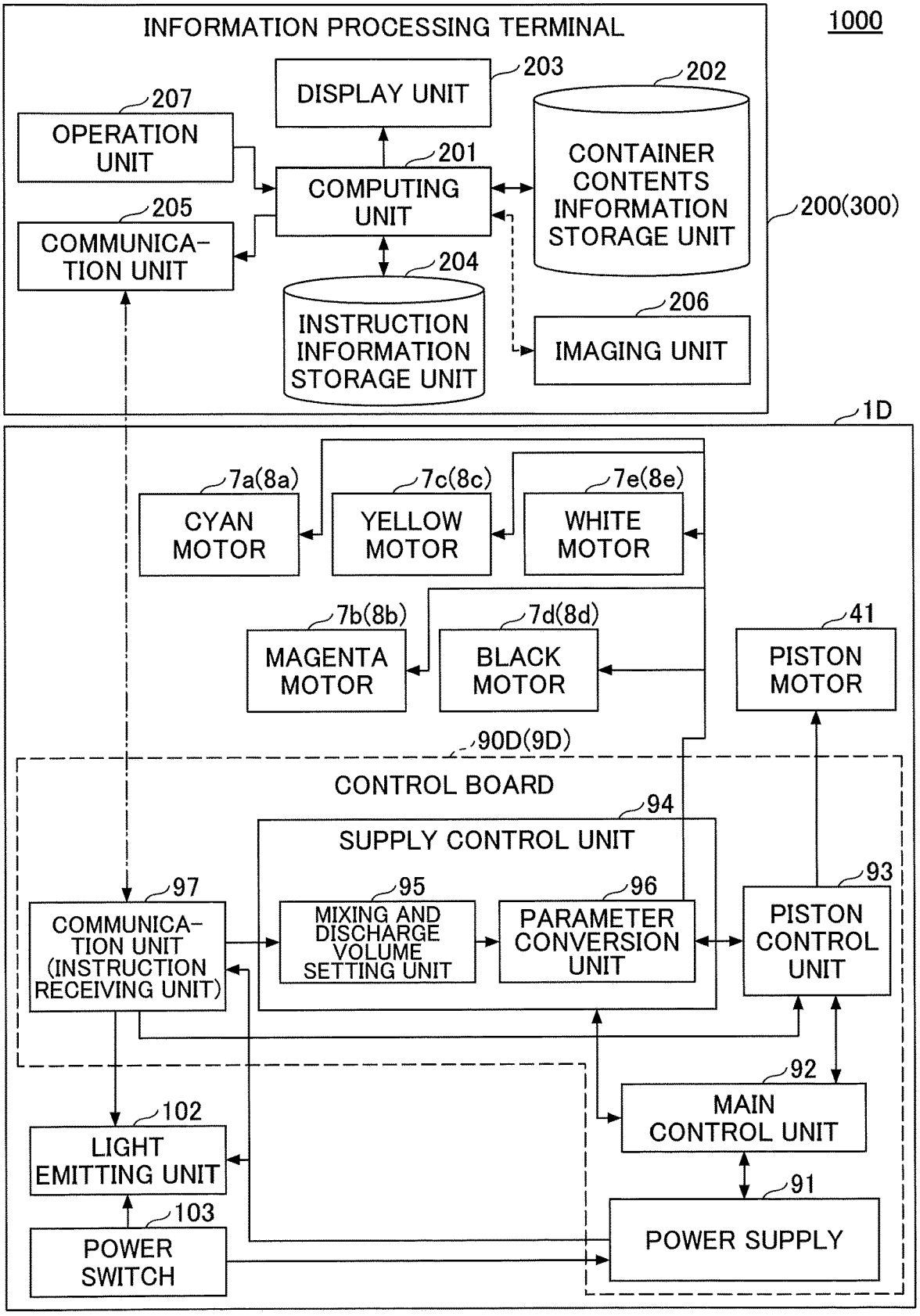
FIG. 12 is a control block diagram of the customized discharge system illustrated in FIG. 11.

FIG. 12 is a functional control block diagram of the customized discharge system 1000 in FIG. 11.

The discharge container 1D included in the customized discharge system 1000 is provided with a communication unit 97 as an instruction receiving unit that receives information transmitted by external devices (information processing terminals 200 and 300) capable of communicating via a network.

The information processing terminal 200 includes a computing unit 201, a container internal content information storage unit 202, a display unit 203, an instruction information storage unit 204, and a communication unit 205.

When the user sets the discharge amount of the discharge container 1D using the information processing terminals 200 and 300, the ratio of the contents and the discharge amount may be directly set in the discharge container 1D in a manner similar to that in the operation unit 101. Alternatively, an operation unit 207 on the information processing terminal 200 and 300 may select the information based on the information after completion from the information separated from the information according to the application (information of the contents inside the container) stored in the information processing terminals 200 and 300.

When selecting based on the information after the completion, the information processing terminal 200 and 300 store in advance the ratio (mixing) of the discharge amount of each content and the completed color tone and skin feel after mixing in the inside of the container information storage unit 202. Then, the color taste and skin feel information after mixing in the predetermined ratio is displayed on the display unit 203, and the user selects the information based on the color taste and skin feel information after mixing. This selection reduces a load on the user to consider the mixing ratio of the contents.

For example, when a cosmetic agent for a base makeup is prepared for the contents (cosmetic agent) having different colors as the contents of the discharge container 1D as described above, the information processing terminal 200 displays a plurality of model colors, for example, the skin colors of ochre, beige, and ivory after mixing, in a step-wise manner by the display unit 203. Then, the user selects the color on the screen, and the computing unit 201 calculates the mix of discharge in accordance with the selected image display color. The communication unit 205 transmits the calculated information to the discharge container 1D, and the discharge container 1D causes the contents of a plurality of different colors to be discharged simultaneously at a predetermined mixing ratio based on the information, and when the user mixes the contents, the color becomes a predetermined complete color.

When a cosmetic agent for partial makeup is prepared for the content (cosmetic agent) having different colors, for example, color of lucent (transparent), white, pink, red, purple, blue, green, brown, or the like may be selected in stages for each color. In this case, the information processing terminal 200 displays the model color of the color tone in the display unit 203 and selects the color on the screen, so that the computing unit 201 calculates the mix of discharge in accordance with the selected image display color.

When a cosmetic for partial make-up is prepared by mixing the above-described cosmetic agents, by changing the discharged color, multiple colors can be enjoyed in one discharge container, and by changing the color setting, multiple applications (for example, eye gross and lip gloss, highlight, shadow, cheek) can be used in one unit.

Even if it is possible to select from the information after completion as described above, a method in which the user examines the ratio and enters the ratio directly may be retained.

In the above description, the contents having different colors (cosmetics) are described as the contents. However, for the contents, for example, the contents having different tactile feelings may be used.

For example, in the case where the basic cosmetic agent is discharged using the contents having different tactile sensations, the mixing ratio of the contents that are suitable for the selection is calculated by selecting information such as "light", "moisture", "normal", "sensitive", "whitening", "anti-acne", and "for packing" on the information processing terminal 200 in accordance with the skin condition, the ambient air temperature and humidity, and the mood of the user. Contents with different tactile sensations are components that affect viscosity. The contents with different tactile sensations, such as basic ingredients, thickened ingredients (moisturizing ingredients), astringent ingredients, whitening ingredients (vitamin C, etc.), acne control ingredients, etc., are previously contained in contents specializing in different functions.

Then, the calculated information is transmitted to the discharge container 1D, and the discharge container 1D discharges the contents of the plurality of different viscosities (the tactile feeling on the skin) at the predetermined mixing ratio based on the information. The discharged contents are mixed to form a basic cosmetic agent that achieves a predetermined effect.

In addition, when the cosmetic agent for the base make is discharged using the contents having different reflectivity of light, the cosmetic agent may be optionally selectable so that the cosmetic agent having different reflectivity of light to the skin can be discharged by adjusting the mixing ratio of the contents even in the same color by selecting "Natural", "Gloss (shining)", or "Matte" according to the condition of the skin, the ambient air temperature and humidity, and the mood of the user.

In the discharge container according to the present invention described above, the contents are stored and transferred separately until the discharge space is reached. Therefore, it is possible to use the contents without deterioration or separation by mixing a plurality of contents which are separated or deteriorated immediately before use. Examples of the foregoing include a vitamin C containing cosmetic agent and a hairdressing agent.

In the above, an example in which the user selects the mixing ratio directly or from the completed information has been described. However, the optimum color combination may be automatically set in the computing unit 201 according to the camera's photographing result. For example, an image capturing unit (camera) 206 may be incorporated in the smartphone 300 illustrated in FIG. 11, or a camera may be mounted to the computer 200, and the skin may be captured by the image capturing unit 206, so that the completed color can be set in accordance with the color of the skin in the photographed image.

For example, in the base make-up, the computing unit 201 of the smartphone 300 automatically selects the color according to the skin color and calculates the mixing ratio, and discharges the color according to the predetermined ratio from the discharge container 1D. Alternatively, in the case of a partial make-up, in the computing unit 201 of the smartphone 300, the color of the make-up color suitable for the skin color may be automatically selected and displayed on the display unit 203 as a recommendation, so that the color can be selected.

In the above description, the discharge container of the present invention has been described with the assumption that the user will appropriately select the discharge container for use in the home, but the discharge container is also suitable for use in a counter at a dealer. By adjusting the mixing ratio at the counter, it is possible to set the contents of the mixing ratio according to the color and preference of each visitor.

In the above description, a cosmetic product that causes a visual change is used as the contents. However, a product having a liquid or viscous fragrance (perfume, or body cream, hand cream, etc. as kneaded perfume) may be used as the contents. By incorporating perfumes or kneaded perfumes into the contents, the user can customize the fragrance.

In addition, although the contents have been described as a cosmetic as an example, a liquid or viscous seasoning may be contained as the contents. By accommodating the seasonings, users can customize the flavor and prepare the amount of the seasonings used for cooking in advance without the use of surveying instruments.

While the preferred embodiment of the invention has been described in detail above, the invention is not limited to the particular embodiment, and various variations and modifications are possible within the scope of the spirit of the embodiments of the invention as defined in the appended claims.

This application claims the priority of Japanese Patent Application No. 2017-154523 filed with the Japan Patent Office on Aug. 9, 2017, and the entire contents of Japanese Patent Application No. 2017-154523 are incorporated herein by reference.

EXPLANATION OF REFERENCE SYMBOLS

1,1A,1B,1C,1D: Discharge container
10: Container body
11: Discharging cylinder
12: Receiving cylinder
13,13B,13C: Discharge face
14: Opening face of discharge hole
15: Discharge hole
16,16B: Recess
161: Recess inner surface
16C: Convex portion
17,18: Fixing support
19: Discharge hole
2,2B: Discharge space
21,21A: Inner wall
22: Inlet hole
25: Cylinder part
26: Stopper
3,3A,3B: Piston
31,31B: Top face
311: Convex portion
312: Distal face portion
31A: Top face portion
32: Piston side face
32A: Cylinder portion
33: Sealing portion (side sealing portion)
34: Piston bottom face
35: Piston rod
4: Piston drive unit
41: Piston motor (rotary motor, gear motor)
45,45A: rotation conveyer (rotation screw)
5*a*,5*b*,5*c*,5*d*,5*e*: Storage portion (extended way)
50*a*,50*b*,50*c*,50*d*,50*e*: Storage portion (suction way)
51: Main body cylinder
52: Operation cylinder
54: Each color piston
6*a*,6*b*,6*c*,6*d*,6*e*: Supply passage
7*a*,7*b*,7*c*,7*d*,7*e*: Extrusion part (extrusion part transfer unit, dispenser type extrusion part)
7A: Extrusion part (extrusion type transfer unit, dispenser type extrusion part)
8*a*,8*b*,8*c*,8*d*,8*e*: Pump (suction way transfer unit)
9: Controller
90,90D: Control board
91: Power supply
92: Main control unit
93: Piston control unit
94: Supply control unit
95: Mixing and discharge volume setting unit
96: Parameter Conversion Unit
97: Communication unit (Instruction receiving unit)
101: Operation unit (instruction receiving unit)
102: Light emitting unit
103: Power switch
200: Notebook personal computer (information processing terminal)
201: Computing unit
202: Container contents information storage unit
203: Display unit
204: Instruction information storage unit
205: Communication unit
206: Imaging unit
300: Smartphone (information processing terminals)
1000: Customized discharge system

The invention claimed is:

1. A discharge container comprising:

a container body extending along a longitudinal axis and having a discharge face at one end of the container body along the longitudinal axis, the discharge face being formed with a recess substantially in a pan shape having a center axis along the longitudinal axis, a wide end opening of the pan shape being coplanar with an end surface of the container, a narrow end opening of the pan shape being disposed inside the container body along the longitudinal axis and being coplanar with a discharge hole for discharging contents;

a cylinder part including a discharge space communicated with the discharge hole, the discharge space being formed inside an inner wall so as to be in a cylindrical shape, an end of the discharge space along the longitudinal axis being closed by the piston, another end of the discharge space along the longitudinal axis facing an outside of the discharge container through the recess;

a piston movable between a first position and a second position, the second position being farther than the first position from the discharge face through the discharge space; and a plurality of storage portions for storing contents, wherein a plurality of inlet holes respectively corresponding to the plurality of storage portions are formed in the inner wall of the discharge space, and the plurality of inlet holes are opened to direct the longitudinal axis, wherein, when the piston is at the second position, the plurality of inlet holes communicate with the discharge space between a top face of the piston and the discharge face, and the contents are ready to flow into the discharge space from the plurality of inlet holes, and wherein, when the piston is at the first position, the plurality of inlet holes are closed by the piston.

2. The discharge container according to claim 1, further comprising:

a plurality of supply passages, through which the plurality of storage portions and the plurality of inlet holes are respectively connected and the contents from the plurality of storage portions pass, wherein, after moving the piston from the first position to the second position to cause the plurality of supply passages and the discharge space communicate through the plurality of inlet holes and cause the contents to flow into the discharge space, the piston is moved from the second position to the first position so that the contents flown inside the discharge space is pushed out of the discharge container from the discharge hole.

3. The discharge container according to claim 2, wherein, in a case where a plurality of contents of different types are respectively accommodated in the plurality of storage portions, the discharge container further comprises:

an instruction receiving unit that receives an instruction about information related to mixture of the plurality of contents; and a supply control unit that sets supply amounts of the plurality of contents to be flown into the discharge space from the plurality of storage portions through the plurality of supply passages and the plurality of inlet holes based on the instruction about the information related to the mixture.

4. The discharge container according to claim 3, further comprising:

a plurality of transfer units for transferring the plurality of contents respectively at the supply amounts adjusted for each of the plurality of adjusted contents from the plurality of storage portions to the plurality of inflow holes, wherein the supply control unit sets a mixture ratio of the plurality of contents based on the instruction about the information concerning the mixture, sets the supply amounts of the plurality of contents, converts the set supply amounts respectively to parameters, and drives the plurality of transfer units based on the parameters, respectively.

5. The discharge container according to claim 1, further comprising:

a sealing portion provided on the outer peripheral surface of the piston at a portion at which the piston contacts the inlet holes.

6. The discharge container according to claim 1, wherein the diameter of the discharge hole is substantially a same as an internal diameter of the cylinder part, and the first position is present at a substantially same position as an opening face of the discharge hole.

7. The discharge container according to claim 1, wherein a diameter of the discharge hole is smaller than an internal diameter of the cylinder part, a convex portion is provided in a center of the top face of the piston, at the first position, the top face of the convex portion of the piston is present substantially at a same position as an opening face of the discharge hole, and a flat face portion other than the convex portion of the piston contacts the inner side surface of the discharge face.

8. The discharge container according to claim 1, wherein, in the discharge face, a peripheral portion of the discharge hole is inwardly recessed in a bowl-like shape.

9. The discharge container according to claim 1, wherein the contents are cosmetics.

10. The discharge container according to claim 3, wherein the instruction receiving unit is an operation unit that is installed on an outer surface of the container body.

11. The discharge container according to claim 3, wherein the instruction receiving unit is a communication unit that receives information transmitted by an external device capable of communicating via a network.

12. A customized discharge system comprising:

a discharge container according to claim 11; and an information processing terminal capable of communicating with the discharge container via the network, the information processing terminal including an instruction reception function for receiving an instruction about information related to the mixture of the plurality of contents.

13. A discharge control method for controlling a discharge container including a container body extending along a longitudinal axis and having a discharge face at one end of the container body along the longitudinal axis, the discharge face being formed with a recess substantially in a pan shape having a center axis along the longitudinal axis, a wide end opening of the pan shape being coplanar with an end surface of the container, a narrow end opening of the pan shape being disposed inside the container body along the longitudinal axis and being coplanar with a discharge hole for discharging contents;

a cylinder part including a discharge space communicated with a discharge hole, the discharge space being formed inside an inner wall so as to be in a cylindrical shape, an end of the discharge space along the longitudinal axis being closed by the piston, another end of the discharge space along the longitudinal axis facing an outside of the discharge container through the recess, a piston movable between a first position and a second position farther than the first position from the discharge face through the discharge space, and a plurality of storage portions storing contents, the discharge control method comprising:

a step of moving the piston from the first position to the second position to substantialize a communication state, in which a plurality of supply passages for connecting a plurality of inlet holes provided in the inner wall of the discharge space with the plurality of storage portions communicates with the discharge space through the plurality of inlet holes opened so as to direct the longitudinal axis;

a step of causing the contents to flow into the discharge space from the plurality of inlet holes; and a step of moving the piston from the second position to the first position to extrude the contents flowing into the discharge space out of the discharge container from the discharge hole.

14. The discharge control method according to claim 13, wherein, in a case where the plurality of contents of different types are respectively accommodated in the plurality of storage portions, the discharge control method further comprises:

a step of receiving an instruction about information related to mixture of the plurality of contents; and a step of setting supply amounts of the plurality of contents to be flown into the discharge space from the plurality of inlet holes to the discharge space.

* * * * *